US005368998A

United States Patent [19]

Ishidai et al.

[11] Patent Number: 5,368,998

[45] Date of Patent: Nov. 29, 1994

[54] SILVER HALIDE COLOR PHOTOGRAPHIC LIGHT SENSITIVE MATERIAL

[75] Inventors: Hiroshi Ishidai; Hiroshi Kita; Yutaka Kaneko; Koji Daifuku, all of Hino, Japan

[73] Assignee: Konica Corporation, Japan

[21] Appl. No.: 179,314

[22] Filed: Jan. 10, 1994

[30] Foreign Application Priority Data

Jan. 14, 1993 [JP] Japan ..... 5-005047
Jan. 14, 1993 [JP] Japan ..... 5-005048

[51] Int. Cl.[5] ..... G03C 7/38
[52] U.S. Cl. ..... 430/558; 430/543
[58] Field of Search ..... 430/558, 543

[56] References Cited

U.S. PATENT DOCUMENTS 4,839,264 6/1989 Kida et al. ..... 430/505
5,118,599 6/1992 Law et al. ..... 430/557

FOREIGN PATENT DOCUMENTS 459331 12/1991 European Pat. Off. ..... G03C 7/30
3101848 10/1986 Japan .

*Primary Examiner*—Lee C. Wright
*Attorney, Agent, or Firm*—Jordan B. Bierman

[57] ABSTRACT

A silver halide color photographic light sensitive material comprising a magenta coupler of Formula is disclosed.

Formula I

In the formula $R^1$, $R^2$, $R^3$, $R^4$ and $R^5$ each represent a hydrogen atom, an aliphatic group, aromatic group or heterocyclic group, wherein $R^1$, $R^2$, $R^3$, $R^4$ and $R^5$ each are same or different, the aliphatic group and aromatic group each may have a substituent(s); $R^6$ and $R^7$ each represent a hydrogen atom or a substituent, wherein $R^6$ and $R^7$ each are same or different and may form a dioxane ring, and the dioxane ring may have a substituent (s); X is a hydrogen atom, or a group or atom which is released upon the reaction with the oxidation product of developing agent; $Z_1$ is a non-metal group to form a 5-membered cycle in combination with a nitrogen atom; the cycle represented by X may have a sustituent(s).

7 Claims, No Drawings

SILVER HALIDE COLOR PHOTOGRAPHIC LIGHT SENSITIVE MATERIAL

FIELD OF THE INVENTION

This invention relates to a silver halide color photographic light sensitive material excellent in image storage ability, color developing property and color reproduction property.

BACKGROUND OF THE INVENTION

Heretofore, in a color paper for direct appreciation, a combination of yellow coupler, a magenta coupler and a cyan coupler has ordinarily been used for forming color dye images. In order to improve fastness of color dye images obtained from the above-mentioned couplers, and to store for along time for using them, many efforts have been conducted.

However, they cannot be sufficient on the point for meeting demands of users to avoid color-fading or discoloration of dye images of color photographs and to store images with high quality permanently. Namely, with regard to storage stability in the dark such as in an album, an epoch making improvement represented by "a century print of Konica color" has been made, making it possible to store photographic images for a satisfactory long time. On the contrary, storage stability in daylight where images are exposed to light (light fastness) has not reached a sufficient level so that an improvement is required. Among the above-mentioned yellow dye, magenta dye and cyan dye, the magenta dye is the weakest in light fastness, in particular, and efforts have been made for the improvement.

Especially, in pyrazoloazole type magenta couplers recently developed, color dyes thereof do not have sub-absorption near 430 nm, which is different from 5-pyrazolone type magenta couplers conventionally used, the formed. Accordingly, they are basically advantageous in terms of color reproducibility. However, it is known that magenta dyes obtained from pyrazoloazole type magenta couplers are inferior to those obtained from 5-pyrazolone type magenta couplers in terms of light fastness. In this connection, many technologies for improvement have been proposed. For example, there are given technologies to use phenol and phenyl ether type compounds disclosed in Japanese Patent Publication Omen to Public Inspection (hereinafter referred to as Japanese Patent O.P.I. Publication) Nos. 159644/1981, 125732/1984, 145552/1986, 262159/1985, 90155/1986 and 39956/1991, those to use amine compounds disclosed in Japanese Patent O.P.I. Publication Nos. 73152/1986, 72246/1986, 189539/1986, 189540/1986 and 95439/1988, those to use metal complex salts disclosed in Japanese Patent O.P.I. Publication Nos. 140941/1986, and those to use 145554/1986, 158329/1986 and 183459/1987, inclusion compounds and heterocycles disclosed in Japanese Patent O.P.I. Publication No. 100048/1990 are cited.

TECHNICAL SUBJECT MATTER OF THE INVENTION

However, when the above-mentioned compounds are used, where sometimes occur a fall of color density of couplers, aging color contamination, color contamination caused by coloring of compounds themselves added, undesirable change in color tone and deterioration of dispersing property of dispersed substances including couplers. Though the above-mentioned improvements offer remarkable effects on improvement in light fastness, it still is the present situation that the light fastness of magenta dyes is inferior compared with yellow dyes and cyan dyes. Accordingly, there occurs a problem that color balance of images is lost in the course of color-fading process so that the colors of photographs are shifted to yellow and cyan, resulting in unnatural discoloration. In addition, a technology to improve light fastness by substituting a pyrazolotriazole skeleton with a branched alkyl group having a large steric hindrance was proposed in Japanese Patent O.P.I. Publication No. 655245/1986. However, it also is not on a sufficient level. Studies for improving coloring property and color reproducibility have been continued. For example, various derivatives are described in Japanese Patent O.P.I. Publication Nos. 55343/1985, 98434/1985 and 120152/1986. However, the above-mentioned couplers still are not on a sufficient level in terms of coloring property of a coupler and a spectral absorption characteristics of a dye. Accordingly, further improvement is desired.

In addition, it has become apparent that the coloring property of the above-mentioned pyrazolotriazole type couplers is easily influenced by slight fluctuation of the conditions of a color developing solution. It has been found out that it is easily influenced especially by the fluctuation of pH value of a color developer (hereinafter referred to as pH fluctuation).

On the other hand, a magenta coupler wherein a nitrogen atom is bounded on a carbon atom which is linked with a pyrazoloazole ring is disclosed in Japanese Patent O.P.I. Publication No. 291058/1988 wherein desirable shift of color hue to a longer wavelength region in dyes formed by pyrazoloazole couplers are given as effects.

However, compounds practically described in Japanese Patent O.P.I. Publication No. 291058/1988 are not still satisfactory in terms of the pH fluctuation.

SUMMARY OF THE INVENTION

The object of the present invention is to provide a silver halide color photographic light-sensitive material excellent in image preservability and excellent in coloring property, color reproducibility and stability in photographic processing.

The silver halide color photographic light sensitive material of the invention comprises a magenta coupler represented by the Formula M-I.

Formula M-I

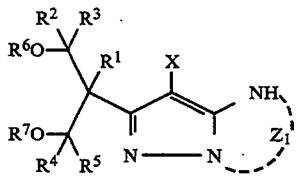

wherein $R^1$, $R^2$, $R^3$, $R^4$ and $R^5$ each represent a hydrogen atom, an aliphatic group, aromatic group or heterocyclic group, wherein $R^1$, $R^2$, $R^3$, $R^4$ and $R^5$ each are same or different, the aliphatic group and aromatic group each may have a substituent(s); $R^6$ and $R^7$ each represent a hydrogen atom or a substituent, wherein $R^6$ and $R^7$ each are same or different and may form a dioxane ring, and the dioxane ring may have a substituent (s); X is a hydrogen atom, or a group or atom which is released upon the reaction with the oxidation product of developing agent; $Z_1$ is a non-metal group to form a 5-metered cycle in combination with a nitrogen atom; the cycle represented by $Z_1$ may have a sustituent(s).

The invention is disclosed more in detail hereafter.

The aliphatic group represented by $R^1$, $R^2$, $R^3$, $R^4$ and $R^5$ may be straight-chained, branched or cyclic, and may be saturated or unsaturated. The aliphatic group may be substituted by other substituent(s). There is no special limitation to the substituents, and the substituents include, typically, each group of aryl, anilino, acylamino, sulfonamido, alkylthio, arylthio, alkenyl or cycloalkyl. In addition to the above, they further include, for example, a halogen atom or each group of cycloalkenyl, alkinyl, heterocyclic, sulfonyl, sulfinyl, phosphonyl, acyl, carbamoyl, sulfamoyl, cyano, alkoxy, aryloxy, heterocyclic-oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, hydroxy, carboxy or heterocyclic-thio and, besides, a spiro compound residual group or an organic hydrocarbon compound residual group.

As for the aryl groups phenyl groups are preferred.

The acylamino groups, include for example, an alkylcarbonylamino group or an arylcarbonylamino group.

The sulfonamido groups an alkylsulfonyl-amino group and an arylsulfonylamino group.

The alkyl components in the alkylthio groups may be straight-chained, branched or cyclic, and may be substituted by other substituent (s), and include for example, a methyl, ethyl, isopropyl, t-butyl, neopentyl, chloromethyl and methoxymethyl group. The aryl group in the arylthio group include a phenyl, 1-naphtyl and 2-naphtyl group, which may be substituted by other substituent (s), and further include, for example, 2-chlorophenyl and 4-methoxyphenyl group.

The alkenyl groups include, preferably, those having 2 to 32 carbon atoms. The cycloalkyl groups represented thereby include, preferably, those having 3 to 12 carbon atoms and, more preferably, those having 5 to 7 carbon atoms. The alkenyl groups may be straight-chained or branched.

The cycloalkenyl groups include, preferably, those having 3 to 12 carbon atoms and, more preferably, those having 5 to 7 carbon atoms.

The sulfonyl groups include, for example, an alkylsulfonyl group and an arylsulfonyl group;

The sulfinyl groups include, for example, an alkylsulfinyl group and an arylsulfinyl group;

The phosphonyl groups include, for example, an alkyl phosphonyl group, an alkoxy phosphonyl group, an aryloxy phosphonyl group and an aryl phosphonyl group;

The acyl groups represented thereby include, for example, an alkyl carbonyl group and an aryl carbonyl group;

The carbamoyl groups represented thereby include, for example, an alkyl carbamoyl group and an aryl carbamoyl group;

The sulfamoyl groups represented thereby include, for example, an alkyl sulfamoyl group and an aryl sulfamoyl group;

The acyloxy groups represented thereby include, for example, an alkyl carbonyloxy group and an arylcarbonyloxy group;

The carbamoyloxy groups represented thereby include, for example, an alkylcarbamoyloxy group and an arylcarbamoyloxy group;

The ureido groups represented thereby include, for example, an alkylureido group and an arylureido group;

The sulfamoylamino groups represented thereby include, for example, an alkylsulfamoylamino group and an arylsulfamoylamino group;

The heterocyclic groups represented thereby include, desirably, those having 5- to 7-members and, typically, a furyl group, a 2-thienyl group, a 2-pyrimidinyl group and a 2-benzothiazolyl group;

The heterocyclic-oxy groups represented thereby include, desirably, those having a 5- to 7-membered heterocyclic ring and, for example, a 3,4,5,6-tetrahydropyranyl-2-oxy group and a 1-phenyltetrazole-5-oxy group;

The heterocyclic-thio groups represented thereby include, preferably, those having 5- to 7-members and, for example, a 2-pyridylthio group, a 2-benzothiazolylthio group and a diphenoxy-1,3,5-triazole-6-thio group; and they may be substituted with a substituent illustrated for the aliphatic group.

The siloxy groups represented thereby include, for example, a trimethylsiloxy group, a triethylsiloxy group and a dimethylbutylsiloxy group;

The imido groups represented thereby include, for example, a succinimido group, a 3-heptadecyl succinimido group, a phthalimido group and a glutarimido group;

The spiro compound residual groups represented thereby include, for example, a spiro[3.3]heptane-1-yl; and The organic hydrocarbon bridging compound residual groups represented thereby include, for example, a bicyclo[2.2.1]heptane-1-yl, tricyclo[3.3.1.137]decane-1-yl and 7,7-dimethyl-bicyclo[2.2.1 ]heptane-1-yl.

The aromatic groups represented by $R^1$, $R^2$, $R^3$, $R^4$ and $R^5$ include a phenyl 1-naphtyl and 2 naphtyl group.

The substituents for substituting the aryl group represented by $R^1$, $R^2$, $R^3$, $R^4$ and $R^5$ include those same as mentioned for the aliphatic group.

A preferable example of $R^1$, $R^2$, $R^3$, $R^4$ and $R^5$ is a hydrogen atom, or a substituted or nonsubstituted alkyl, cycloalkyl, aryl, alkenyl or alkinyl group, and most preferable is a substituted or nonsubstituted alkyl or aryl group The groups capable of splitting off upon reaction with the oxidized product of a color developing agent, which are represented by X, include, for example, a halogen atom (such as a chlorine atom, a bromine atom and a fluorine atom) and each of the groups of alkoxy, aryloxy, heterocyclic-oxy, acyloxy, sulfonyloxy, alkoxycarbonyloxy, aryloxycarbonyl, alkyloxalyloxy, alkoxyoxalyloxy, alkylthio, arylthio, heterocyclic-thio, alkyloxythiocarbonylthio, acylamino, sulfonamido, nitrogen-containing heterocyclic ring bonded with an N atom, alkyloxycarbonylamino, aryloxycarbonylamino and carboxyl. Among them, halogen atoms including, particularly, a chlorine atom are preferable.

Examples of nitrogen containing 5-metered heterocycles include pyrazole ring, imidazole ring, triazole ring and tetrazole ring, which may have a substituent mentioned for a substituent for R.

Example of $R^6$ and $R^7$ includes a hydrogen atom, alkyl group and a hydroxyalkyl group, wherein the alkyl or hydroxyalkyl group preferably has 1 to 5 carbon atoms The other example of $R^6$ and $R^7$ dioxane, and the formula is written;

M-Ia

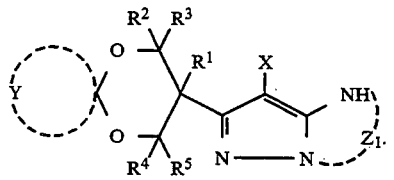

In the formula, Y is a non-metal group to form a 3- to 7-membered cycle in combination with a carbon atom. The cycle represented by Y may have a sustituent(s). $R^1$ through $R^5$, X and $Z_1$ are respectively the same as $R^1$ through $R^5$, X and $Z_1$ mentioned above.

Examples of 3 to 7-membered aliphatic cycles and heterocycles represented by Y include cycloalkanes, cycloalkenes, cycloalkines, terpenes, pyrrolidine, pyrroline, pyrazoline, piperidine, morpholine, quinuclidine, unsaturated pyrans, oxazolan and oxathiorane, those may have a substituent mentioned for the substituent for $R^1$, $R^2$, $R^3$, $R^4$ and $R^5$. Of these cycles preferable examples are cycloalkanes, terpenes and unsaturated pyrans.

The compound represented by the formula M-I is shown more in detail by formulas M-II to M-V.

M-II

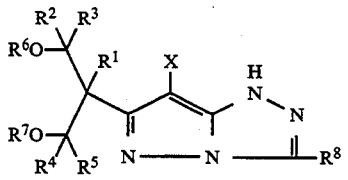

M-III

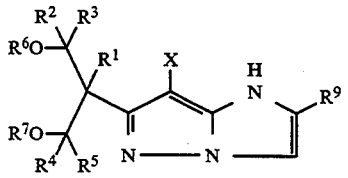

M-IV

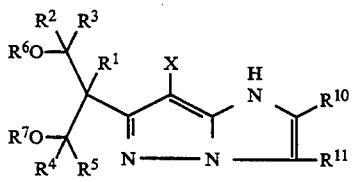

M-V

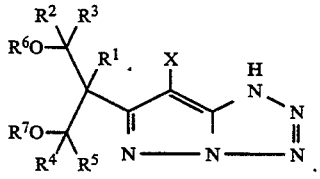

The compound represented by the formula M-Ia is shown more in detail by formulas M-IIa to M-Va.

M-IIa

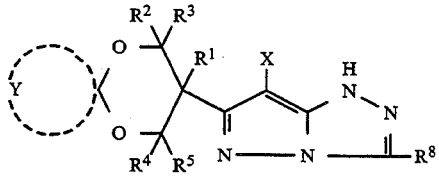

M-IIIa

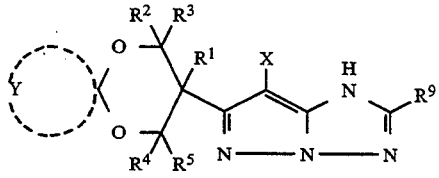

M-IVa

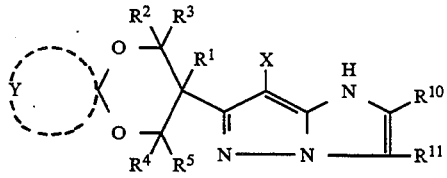

M-Va

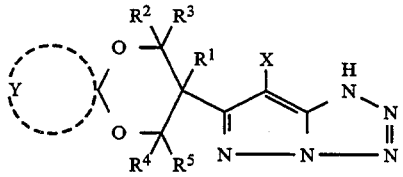

In the formulas M-II to M-V and M-IIa to M-Va, $R^1$ through $R^{12}$, X are the same as $R^1$ through $R^5$, X mentioned above respectively. Preferable examples of $R^1$ through $R^5$ are a hydrogen atom and an alkyl group. Preferable examples of cycles formed by Y are cyclohexane, cycloheptane, cyclohexene, cycloheptene, piperidine, dioxane, furan, dioxene, cyclohexadiene-on, adamantane, cyclopropene and norbornene. The most preferable examples thereof are cyclohexane, cycloheptane, piperidine and adamantane.

The most preferable example of these is one represented by formula M-II and M-IIa.

A substituent with which may substitute the cycle represented by Z of the formula M-I and $Z_1$ of the formula M-VIII, and a group for $R^3$ through $R^9$ are preferably those mentioned for $R^1$ and $R^2$ above.

Typical examples of the magenta coupler of the invention are illustrated, but the scope of the invention is not limitatively construed by these examples.

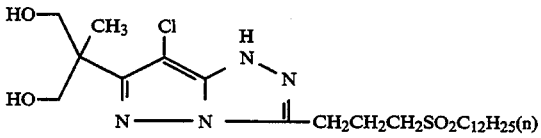

1

-continued
2
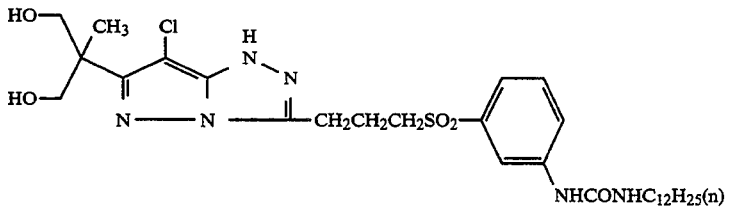
3
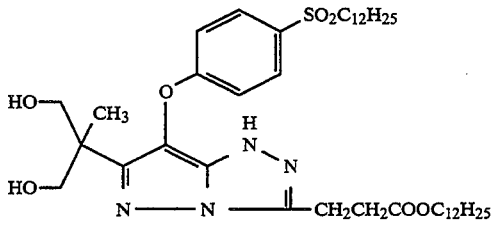
4
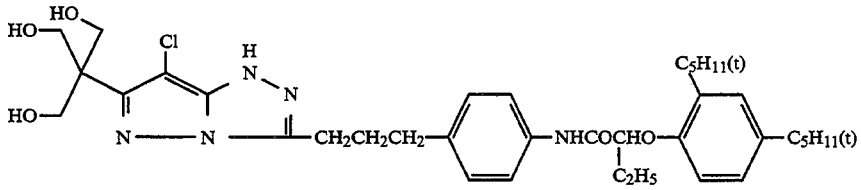
5
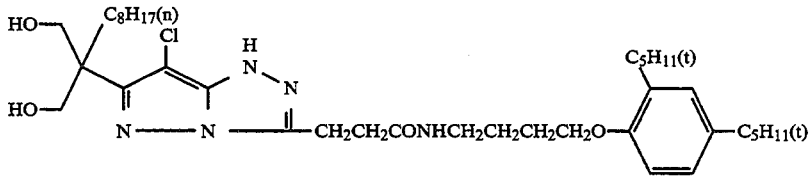
6
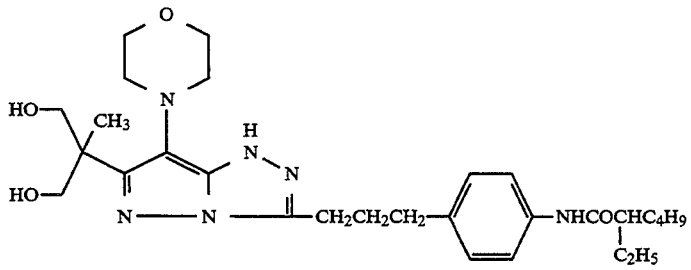
7
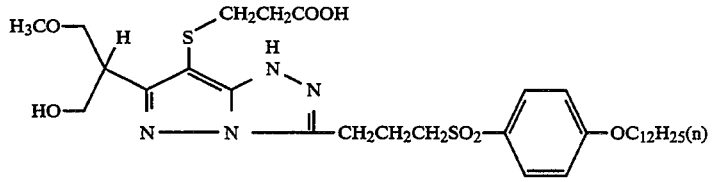
8
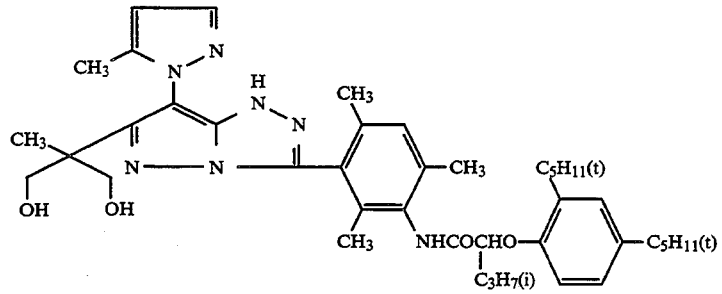

-continued
9
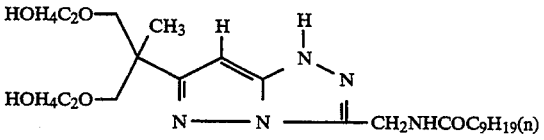
10
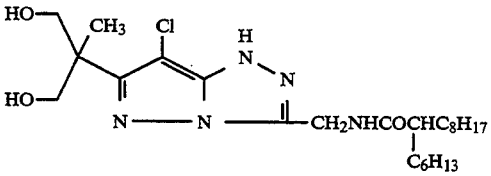
11
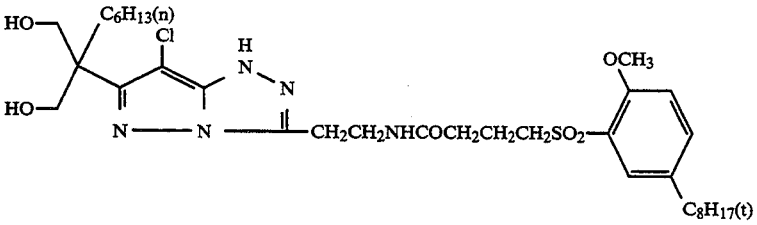
12
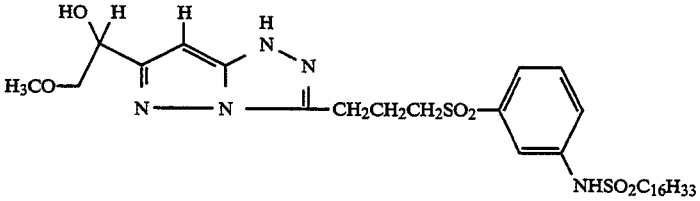
13
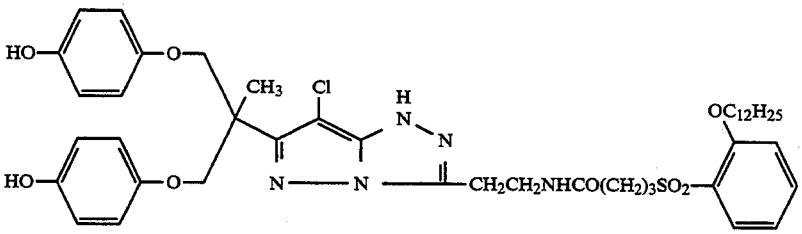
14
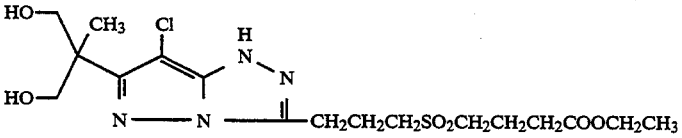
15
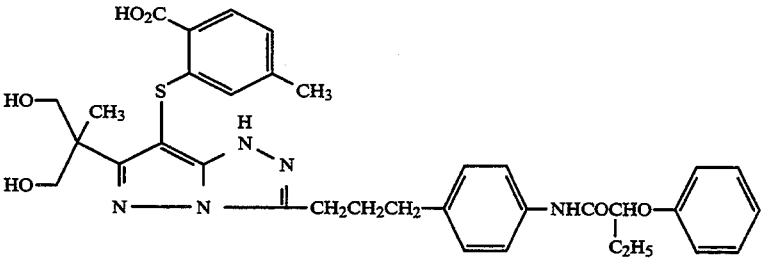
16
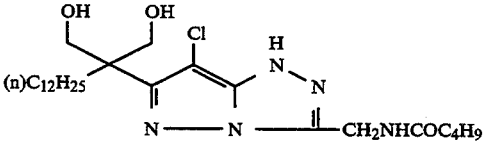

-continued
17
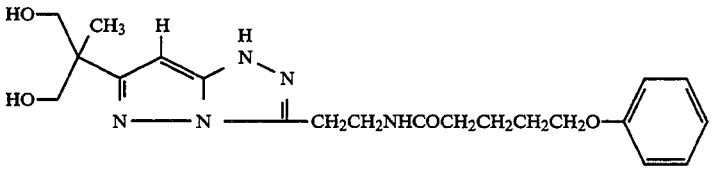
18
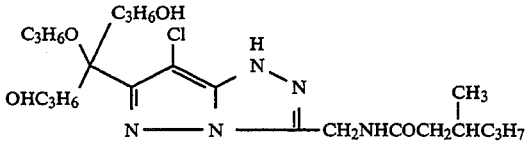
19
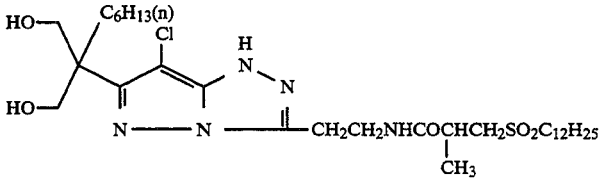
20
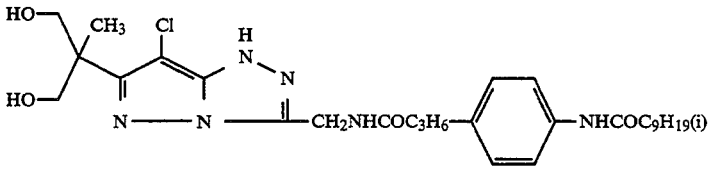
21
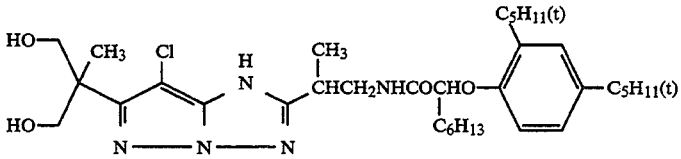
22
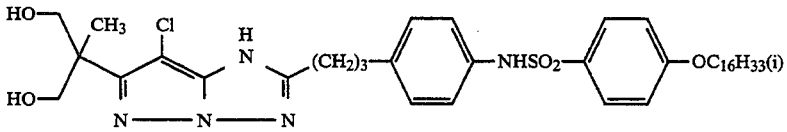
23
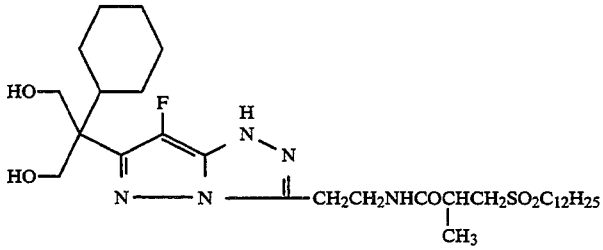
24
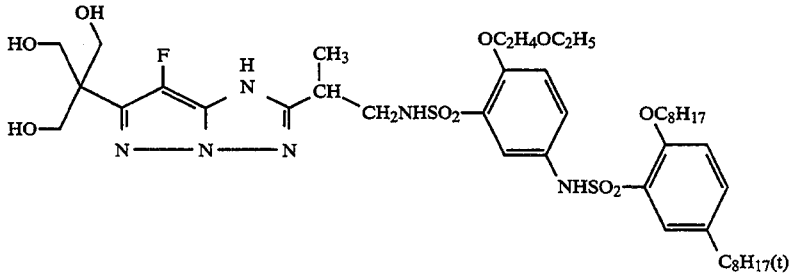

-continued
25
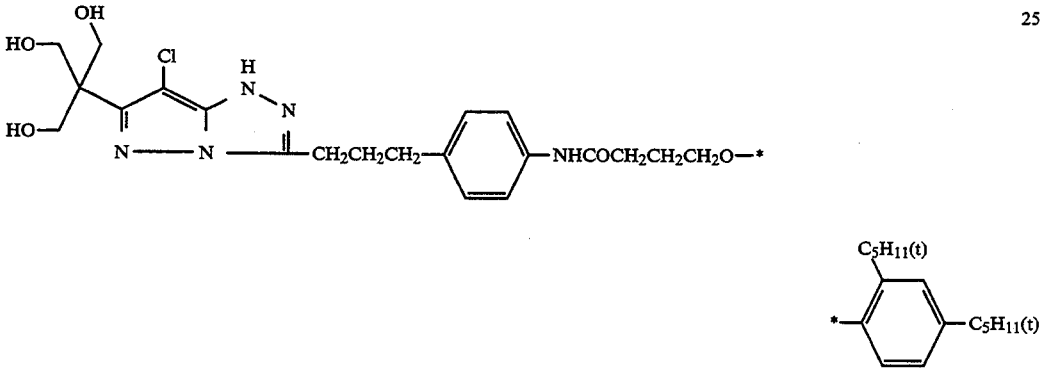
26
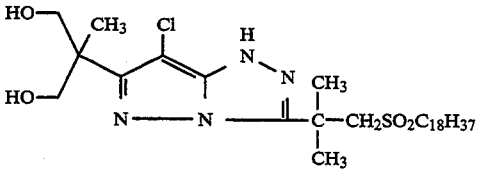
27
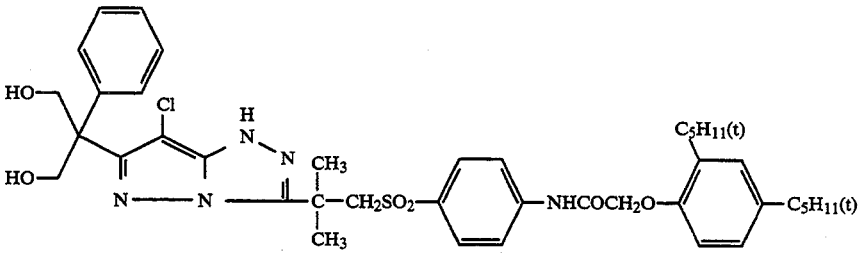
28
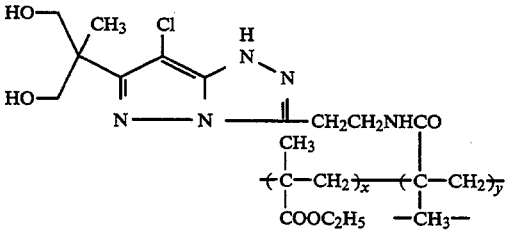
101
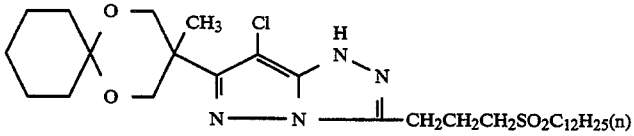
102
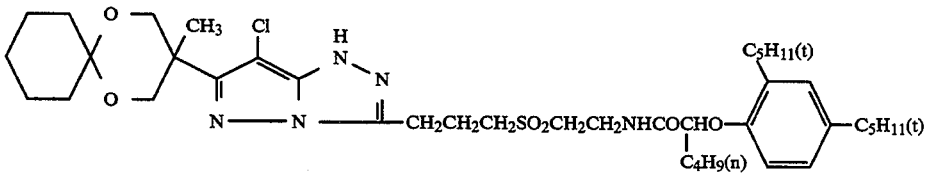
103
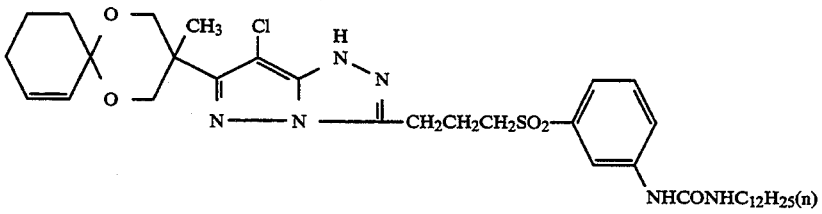

-continued
104
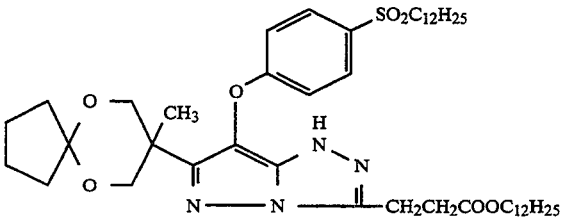
105
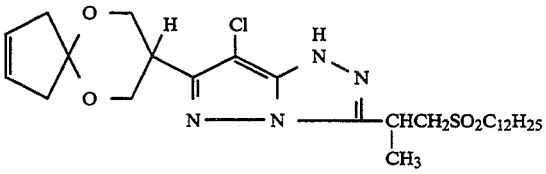
106
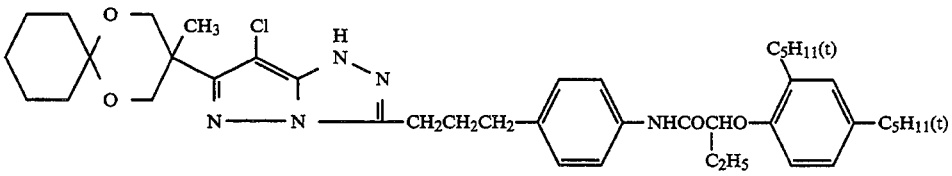
107
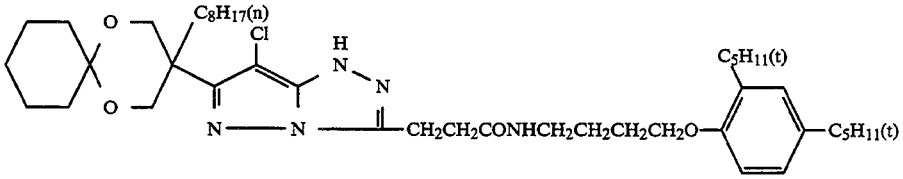
108
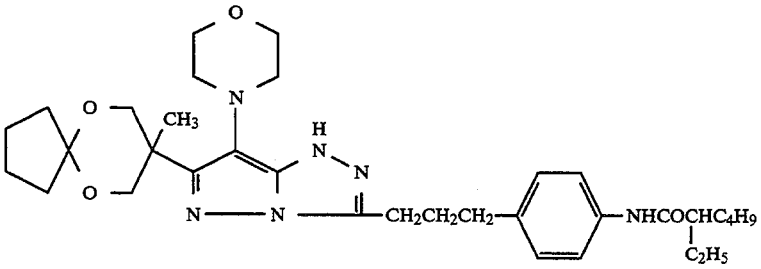
109
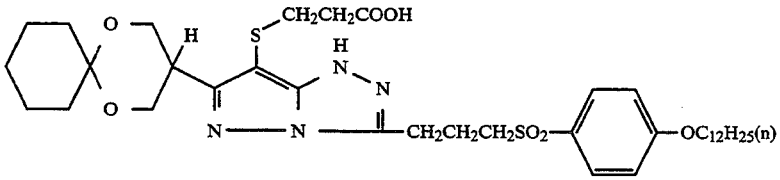
110
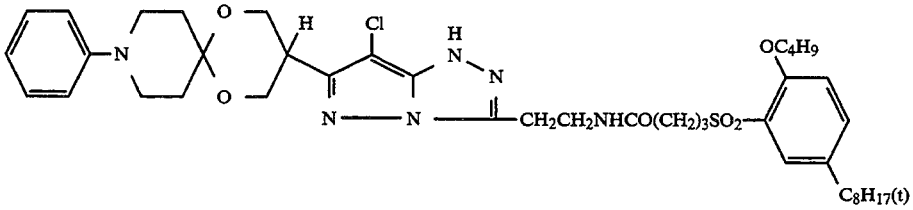
111
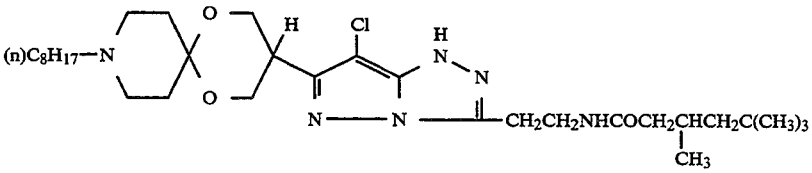

-continued
112
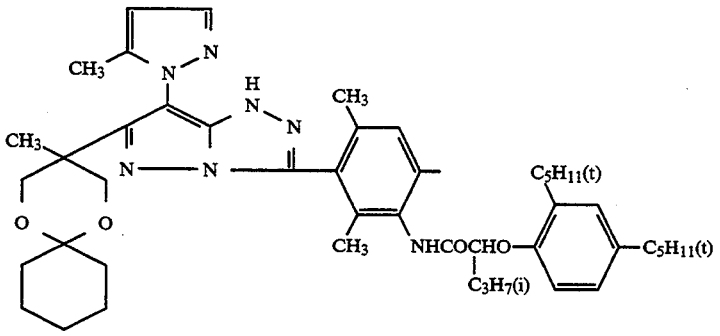
113
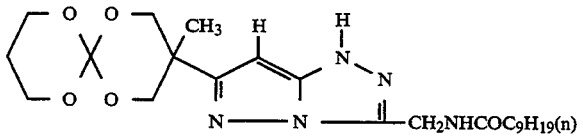
114
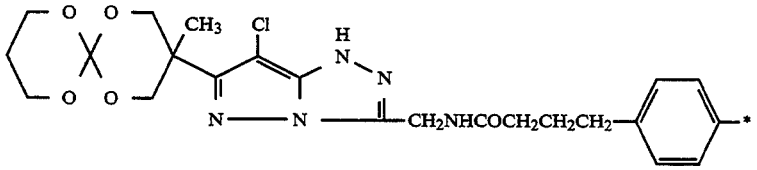
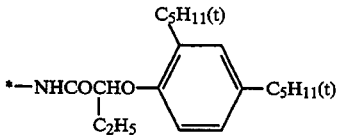
115
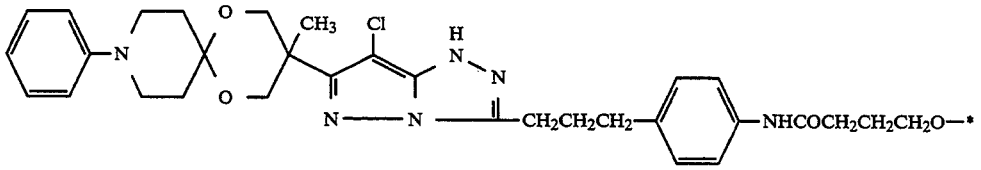
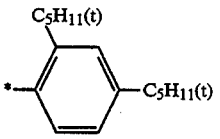
116
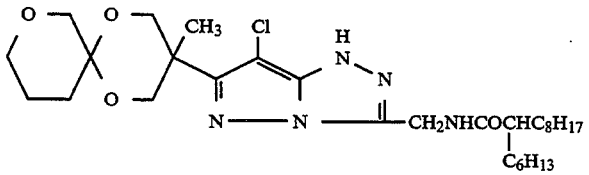
117
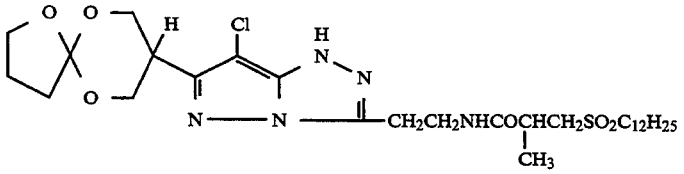

-continued
118
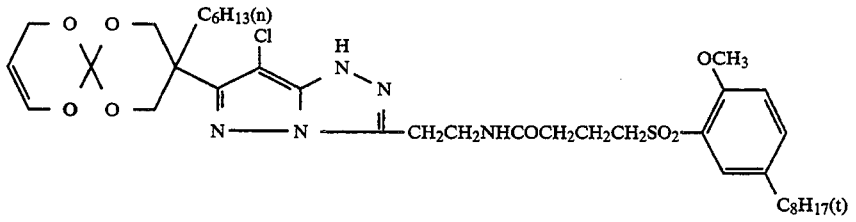
119
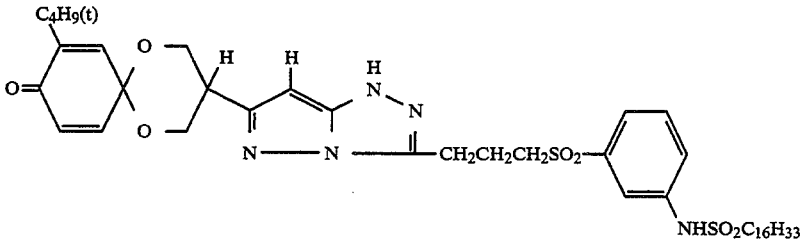
120
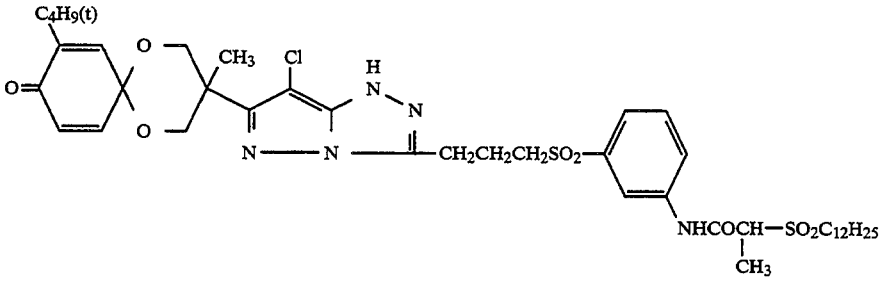
121
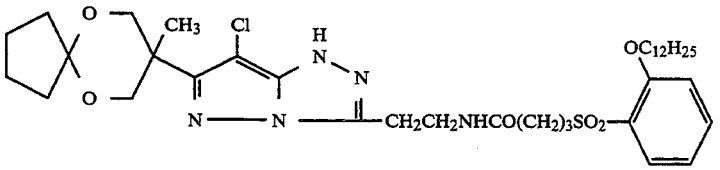
122
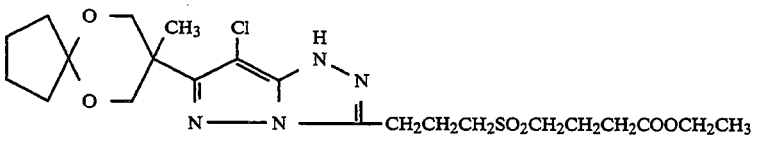
123
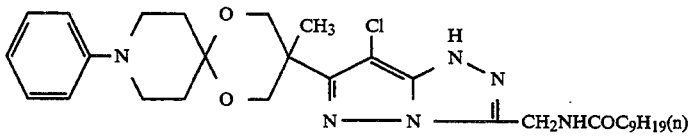
124
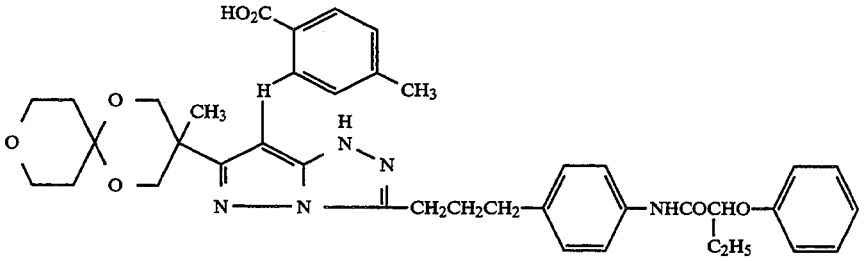

-continued
125
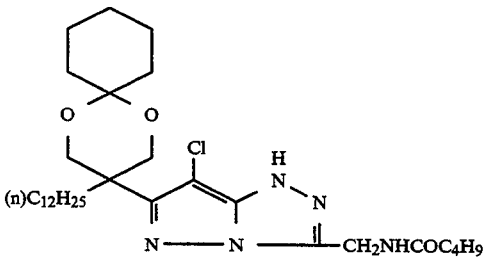
126
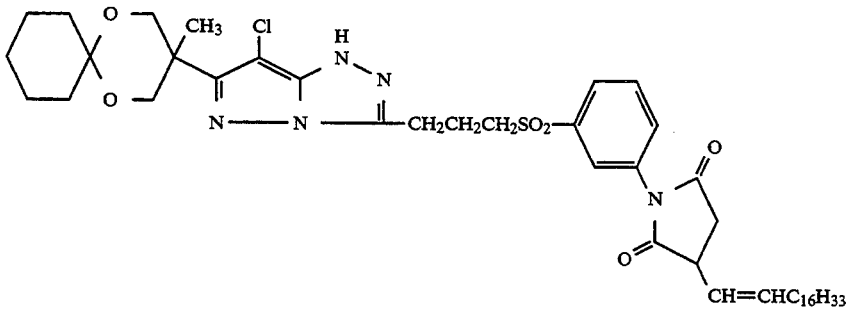
127
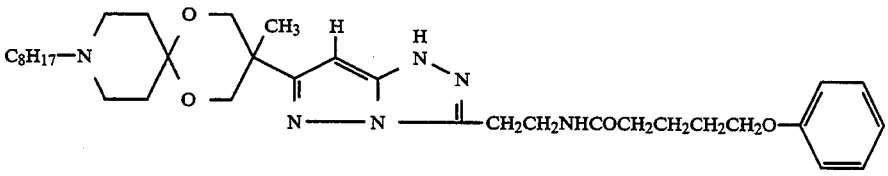
128
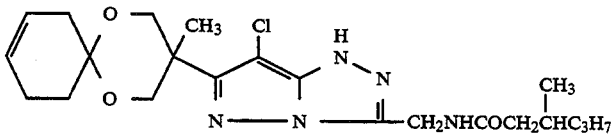
129
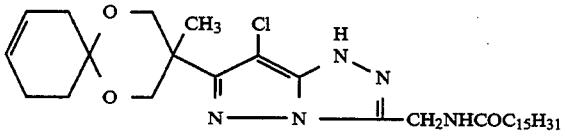
130
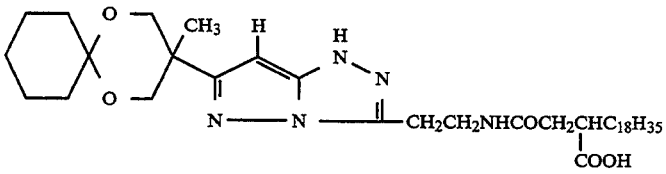
131
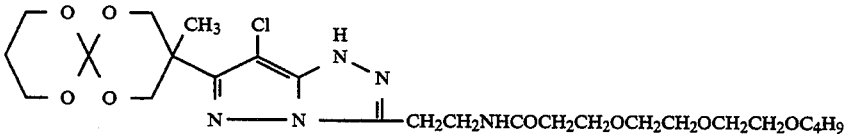
132
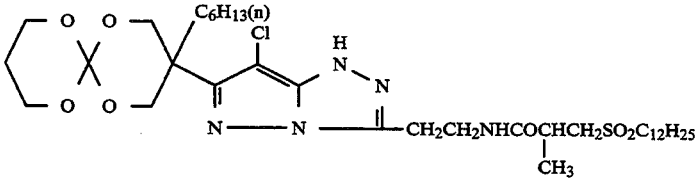

-continued
133
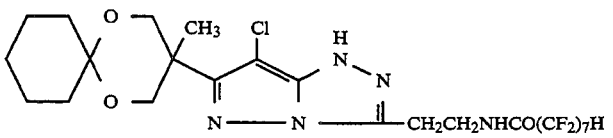
134
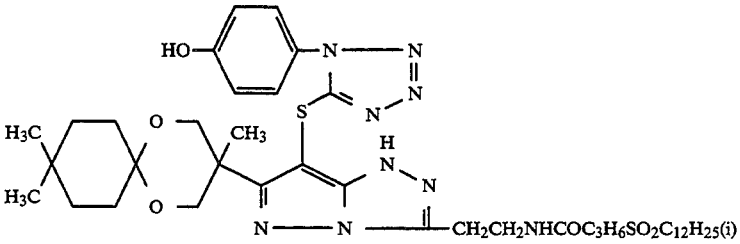
135
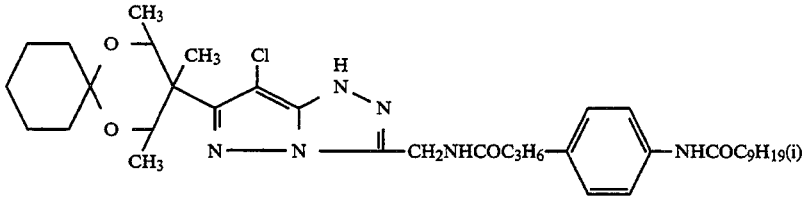
136
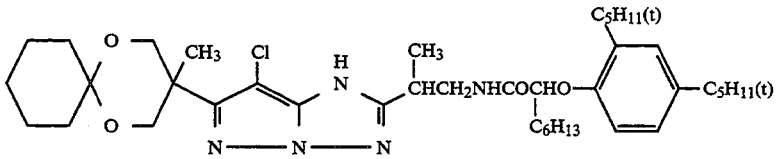
137
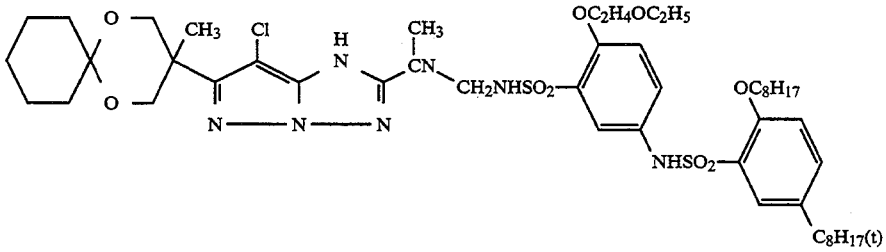
138
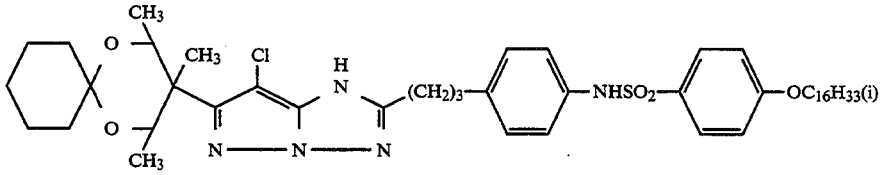
139
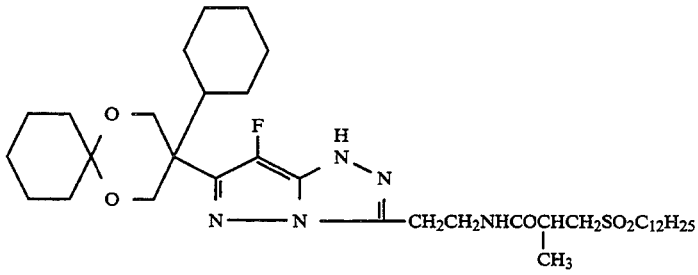

-continued
140
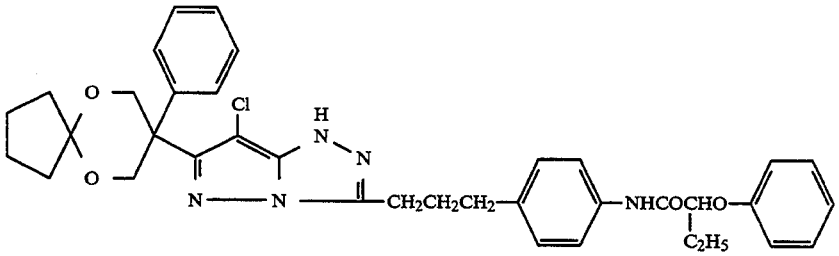
141
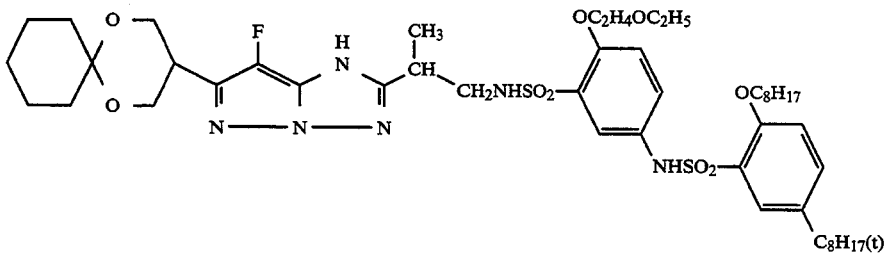
142
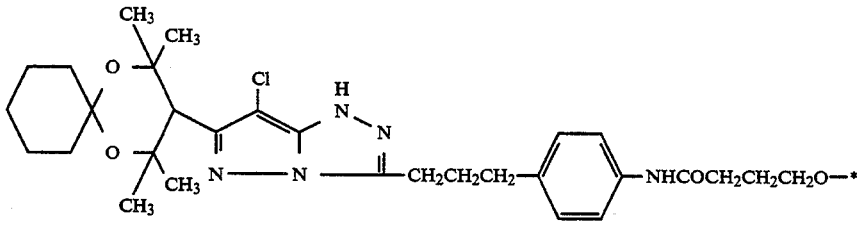
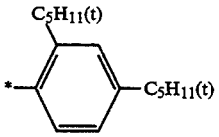
143
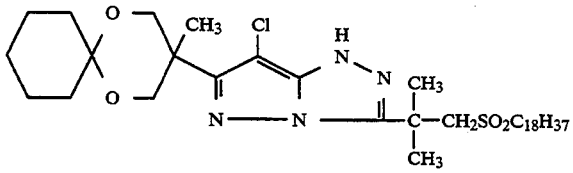
144
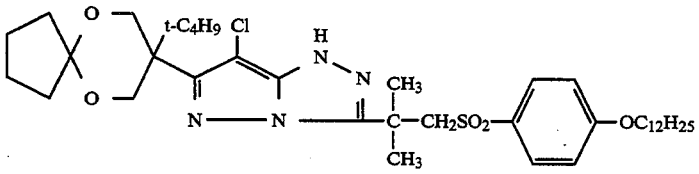
145
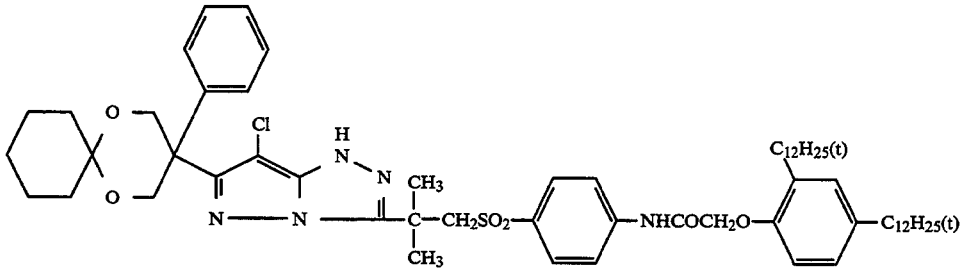

-continued
146
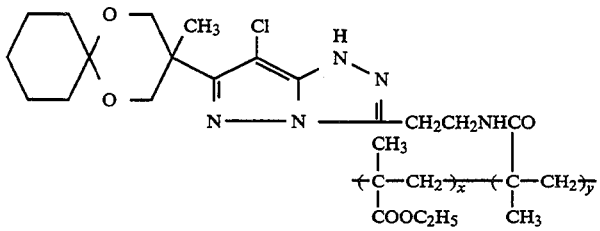
147
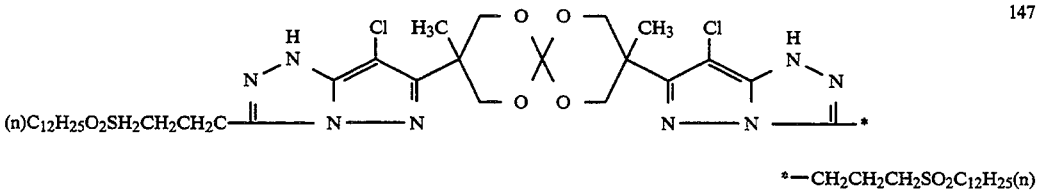
148
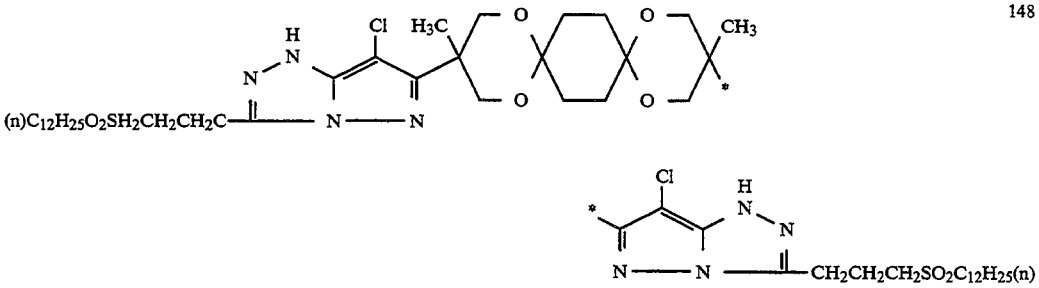
149
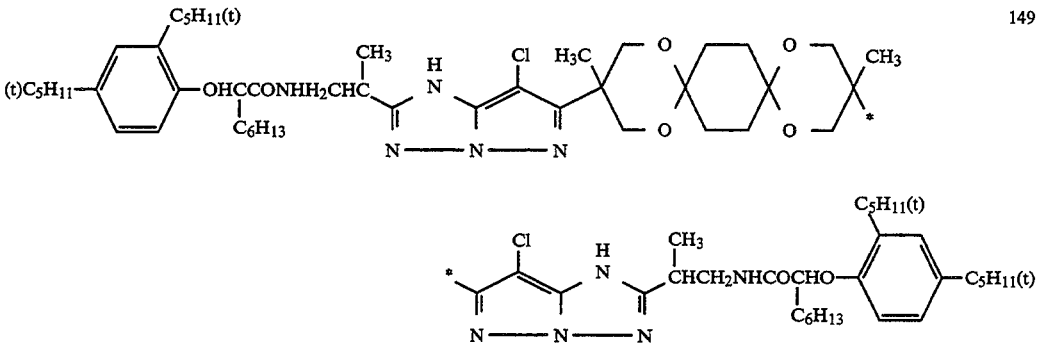
150
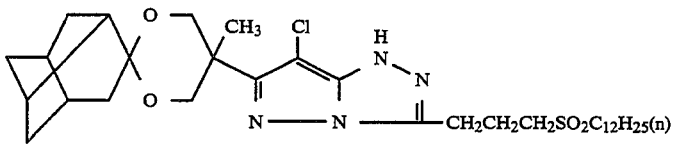
151
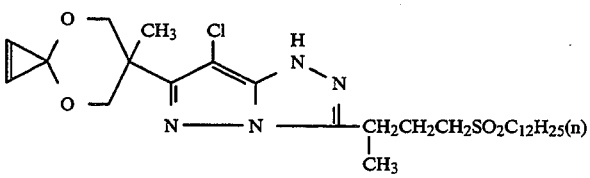
152
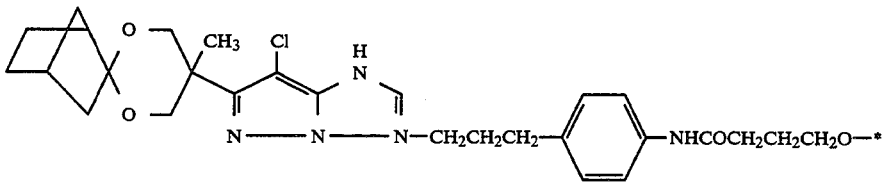

-continued

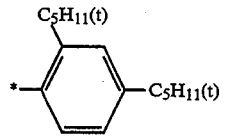

The magenta coupler of the invention represented by the formula M-I is synthesized easily by referring to, for example, Journal of the Chemical Society, Perkin; I (1977),.pp 2047 to 2052, U.S. Pat. No. 3,725,067, or Japanese Patent O.P.I. Publications 59-99439, 59-171956, 60-43659 and 60-172982, for a skilled person in the art.

Typical example of the synthesis of the magenta coupler are illustrated.

SYNTHESIS EXAMPLE

Synthesis of exemplified compound 1

I) The synthesis procedures

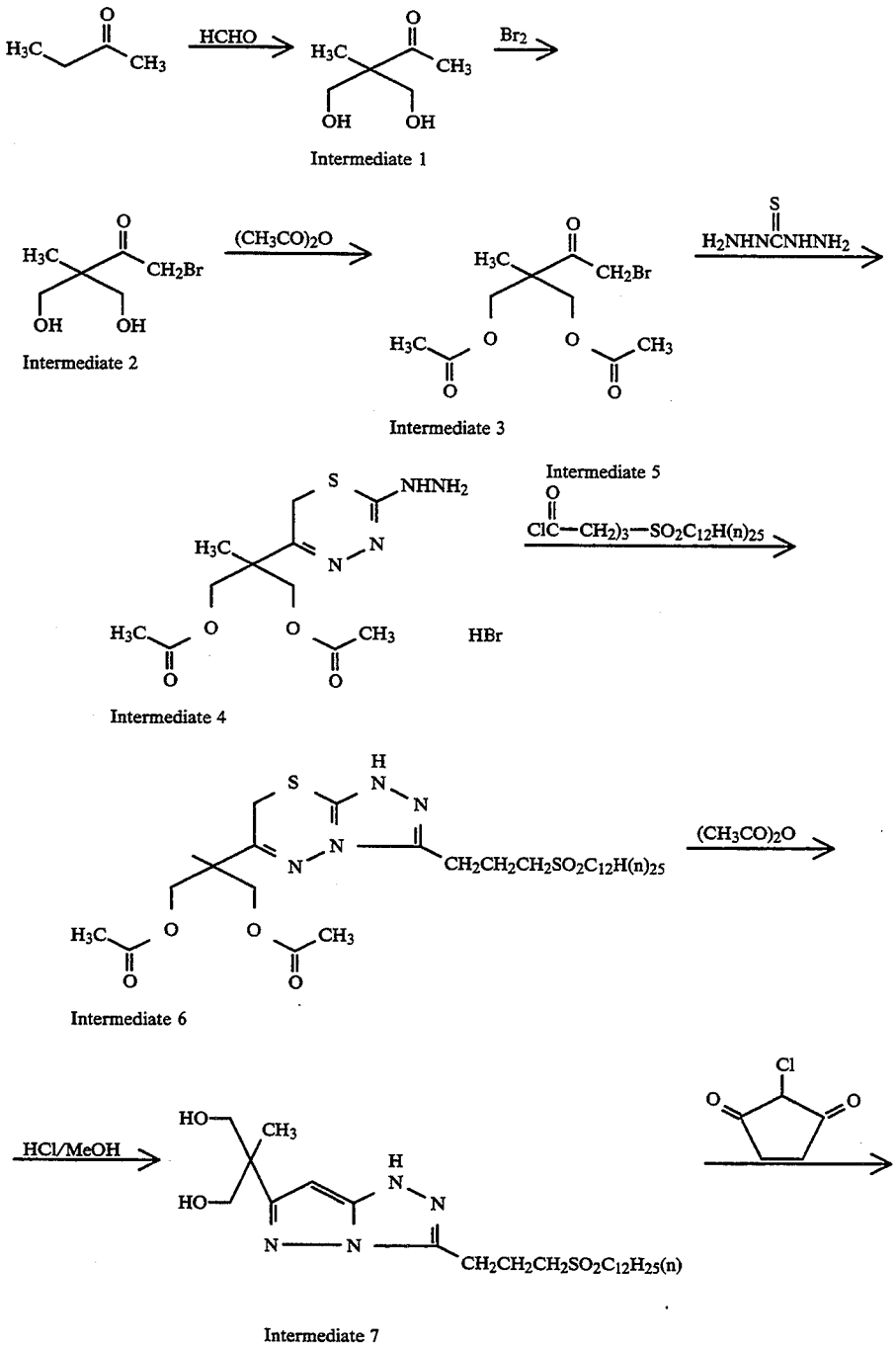

-continued

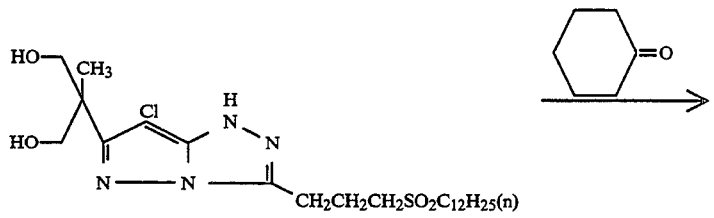

EXEMPLIFIED COMPOUND 1

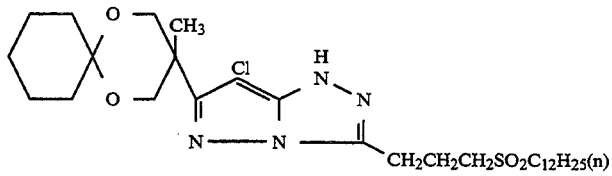

Exemplified Compound 101

II). Synthesis of Intermediate 1

To 150 ml of water dissolving 0.2 g of calcium hydroxide, 21.6 g of 2-butadinon and 51.5 g of 35% formalin were added and stirred for 12 hour at the temperature between 10 and 15° C. The resultant was neutralized with hydrochloric acid, and reactant was extract with 300 ml of ethylacetate, dried with magnesium sulfate anhydride and concentrated under reduce pressure. To the resultant a mixture of 20 ml of chloroform and 20 ml of hexane was added and stirred for some time, then white crystals were deposited. They were filtered and dried under reduced pressure to obtain 34.9 g (yield 88%) of the Intermediate 1.

The structure thereof was confirmed by $^1$HNMR, IR spectral analysis and FD mass-spectral analysis.

B. Synthesis of Intermediate 4

III) Synthesis of Intermediate 2

The Intermediate 1 in an amount of 34.0 g was dissolved in 2 liter of chloroform and stirred at the temperature between −10° and −15° C. Bromine in an amount of 34.1 g was added dropwise thereto for 2 hours. After the addition, stirring was continued for 2 hours at the room temperature. To the resultant 70 g of ice and 70 g of water was added and water phase was separated. To the water phase 300 ml of acetate was and the reactant was extracted, dried with magnesium sulfate anhydride and concentrated under reduced pressure to obtain pale yellow liquid. It was separated through column chromatography to obtain 34.2 g (yield 63%) white crystals. The structure thereof was confirmed by $^1$HNMR, IR spectral analysis and FD mass-spectral analysis.

IV) Synthesis of Intermediate 3

To 150 ml of ethylacetate, 33.8 g of the Intermediate 2 was added and stirred for 16 hours at 0° C. The resulted liquid was poured into 100 g of ice and 50 ml of 1 N hydrochloric acid, 200 ml of ethyl acetate was added and organic phase was separated. The resultant was neutralized with sodium hydrogen carbonate, and organic phase, after separation, was dried with magnesium sulfate and concentrated under reduced pressure to obtain 46.8 g of pale yellow transparent liquid of the Intermediate 3 (yield 99%). The structure thereof was confirmed by $^1$HNMR, IR spectral analysis and FD mass-spectral analysis.

IV) Synthesis of Intermediate 4

Thiocarbohydrazide in an amount of 17.0 g was added 500 ml of methanol and was stirred at room temperature. 460 ml of the Intermediate 3 dissolved in 100 ml of methanol was added dropwise thereto for 1.5 hours. Stirring was continued for 4 hours, after the addition, then further 2 hours at 40° C. The reacted liquid was concentrated, as it is, under reduced pressure to obtain yellow transparent oil to which 150 ml of acetonitrile was added and stirred . Deposited white crystal were separated by filtration, washed, and dried to obtain 53.2 g of the Intermediate 4 (yield 89%). The structure thereof was confirmed by $^1$HNMR, IR spectral analysis and FD mass-spectral analysis.

IV) Synthesis of Intermediate 6

To 1 l of acetonitrile 52 g of the Intermediate 4 was added and then 46 g of acid chloride Intermediate 6 was added and the mixture was refluxed with stirring for 6 hours. The resultant was cooled and indissolved material was removed by heat filtration, and the filtered liquid is concentrated under reduced pressure to obtain 78 g of brown Intermediate 6 (yield 98%). The structure thereof was confirmed by $^1$HNMR, IR spectral analysis and FD mass-spectral analysis.

VII) Synthesis of Intermediate 7

Adding 500 ml of acetic acid anhydride to 75 g of the Intermediate was added, the mixture was refluxed with stirring and heating for 1 hour, and then further stirring and heating was continued in keeping removing excess acetic acid anhydride (in an amount of about 480 ml) under reduced pressure. After removing the resultant was cooled to room temperature, 500 ml. of methanol and 50 ml of concentrated hydrochloric acid was added thereto, the mixture was kept heating and reflux for 3 hours. Deposited sulfur was separated by filtration, and then from the filtered liquid methanol was removed by distillation under reduced pressure. The reactant was extracted with 600 ml of ethyl acetate, then neutralized with sodium hydroxide. It was washed with water three times, ethyl acetate was removed by distillation under reduced pressure, after drying with magnesium sulfate anhydride. The resulted pale reddish white oil was refined through column chromatography to obtain 49.9 g of slight orange oily Intermediate 7 (yield 83%). The structure thereof was confirmed by $^1$HNMR, IR spectral analysis and FD mass-spectral analysis.

VIII) Synthesis of Exemplified Compound 1

In 500 ml of chloroform 48.2 g of the Intermediate 7 was dissolved, and the mixture was stirred at 5° C. 13.9 g of N-chlorosuccinimide was added taking about 2.5 hours. After the addition, stirring was kept for 2 hours. The reactant was washed with 50 ml of water and then, after drying with magnesium sulfite anhydride, chloroform was removed by distillation under reduced temperature to obtain orange oily compound. The compound was refined by means of column chromatography to obtain 40.3 g of 8 slight orange solid Exemplified Compound 1 (yield 78%). The structure thereof was confirmed by $^1$HNMR, IR spectral analysis and FD mass-spectral analysis.

XI) Synthesis of Exemplified Compound 101

The Exemplified Compound 1 in an amount of 38.7 g was mixed with 800 ml of toluene, 2.0 g of p-toluenesulfonic acid and 9.1 g of cyclohexanone, and the mixture was kept refluxing and heating for 5 hours, the reactant was washed with 500 ml of water twice, and dried with magnesium sulfate anhydride. After removing toluene by distillation under reduced pressure, the obtained slightly yellow oil was refined by means of column chromatography to obtain 32.3 g of slightly yellow amorphous (yield 72%). The structure thereof was confirmed $^1$HNMR, IR spectral analysis and FD mass-spectral analysis.

The magenta coupler may be incorporated in an emulsion in a well-known method. For example, the magenta coupler relating to the invention can be contained in a silver halide emulsion in the following manner. The magenta coupler is dissolved in a high boiling organic solvent having a boiling point of not lower than 175° C. such as tricresyl phosphate and dibutyl phthalate or a low boiling solvent such as ethyl acetate and butyl propionate independently or, if required, in the mixture thereof independently or in combination, and the resulting solution is mixed with an aqueous gelatin solution containing a surfactant. After that, the resulting mixture is emulsified by making use of a high-speed rotary mixer or a colloid-mill and the emulsified mixture is then added into the silver halide emulsion.

The magenta coupler relating to the invention may usually be used in an amount within the range of $1\times10^{-3}$ to 1 mol and, preferably, $1\times10^{-2}$ to $8\times10^{-1}$ mols per mol of silver halide.

It is also allowed to use the magenta couplers with other kinds of magenta couplers in combination.

The silver halides desirably used in the invention are comprised of silver chloride, silver chlorobromide or silver chloroiodobromide and, further, they may also be comprised of a combined mixture such as the mixture of silver chloride and silver bromide.

In the silver halide emulsions applicable to the invention, it is allowed to use any one of silver halides such as silver bromide, silver iodobromide, silver iodochloride, silver chlorobromide, silver chloroiodobromide and silver chloride, provided, they can be used in ordinary silver halide emulsions.

The silver halide grains may be either those having the uniform distribution of silver halide compositions inside the grains or those of the core/shell type having the different silver halide compositions between the inside of the grains and the surface layers of the grains.

The silver halide grains may be either those capable of forming a latent image mainly on the surfaces thereof or those capable of forming a latent image mainly inside the grains thereof.

The silver halide grains may be either those having a regular crystal form such as a cube, octahedron or tetra decahedron or those having an irregular crystal form such as a globular or tabular form. It is allowed to use the grains having any ratios of {100} planes to {111} planes.

These grains may also have a mixed crystal form or may be mixed with the grains having various crystal forms.

The silver halide grains applicable there to are to have a grain size within the range of, desirably, 0.05 to 30 $\mu$ and, preferably, 0.1 to 20 $\mu$.

The silver halide emulsions having any grain size distributions may be used. It is, therefore, allowed to use either the emulsions having a wide grain size distribution (hereinafter referred to as 'polydisperse type emulsions') or the independent or mixed emulsions having a narrow grain size distribution (hereinafter referred to as 'monodisperse type emulsions'). It is, further, allowed to use the mixtures of the polydisperse type and monodisperse type emulsions.

The couplers applicable to the invention include a colored coupler capable of displaying a color compensation effect and the compounds capable of releasing a photographically useful fragment such as a development retarder, a development accelerator, a bleach accelerator, a developing agent, a silver halide solvent, a color toner, a layer hardener, a foggant, an antifoggant, a chemical sensitizer, a spectral sensitizer and a desensitizer. Among these compounds, it is also allowed to use the so-called DIR compounds capable of releasing a development retarder in the course of carrying out a development and improving the sharpness and graininess of an image.

The above-mentioned DIR compounds include those containing a retarder directly coupled to the coupling position thereof and those containing a retarder coupled to the coupling position through a divalent group and capable of releasing the retarder either upon intramolecular nucleophilic reaction or upon intramolecular electron-transfer reaction, produced in a group split off upon coupling reaction, (the latter compounds are hereinafter referred to as 'timing DIR compounds'). The retarders applicable thereto include those becoming diffusible upon splitting off and those not having a diffusibility so much, independently or in coordination so as to meet the purposes of application.

The above-mentioned couplers are to make a coupling reaction with the oxidized products of an aromatic primary amine developing agent and these couplers may also be used in combination with a colorless coupler not forming any dyes (hereinafter referred to as 'competing coupler') as a dye-forming coupler.

The yellow couplers preferably applicable to the invention include, for example, the well-known acylacetanilide type couplers. Among these couplers, benzoyl acetoanilide type and pivaloyl acetoanilide type compounds may advantageously be used.

The cyan couplers preferably applicable to the invention include, for example, phenol type and naphthol type couplers.

It is also allowed to use a color-fog inhibitor for the purposes of preventing a color stain, a sharpness deterioration and/or a rough graininess, which may be produced by transferring the oxidized products of an developing agent or an electron transferor between the emulsion layers of a light sensitive material (i.e., between the same color-sensitive layers and/or between the different color-sensitive layers).

An image stabilizer capable of preventing the deterioration of a dye image may be applied to the light sensitive materials of the invention. The compounds preferably applicable thereto are described in, for example, RD 17643, Article VII-J.

For the purposes of preventing any fog from being produced by a electric discharge generated by frictionally static-charging a light sensitive material and preventing an image from being deteriorated by UV rays, a UV absorbent may also be contained in the hydrophilic colloidal layers thereof such as the protective layers and interlayers.

For the purpose of preventing a magenta-dye forming coupler from being deteriorated by formalin in the course of preserving a light sensitive material, a formalin scavenger may further be used in the light sensitive material.

The invention can preferably be applied to a color negative film, a color paper, a color reversal film and so forth.

The color negative film, the color paper and the color reversal film each comprise, in general, blue-, green- and red-sensitive silver halide emulsion layers and a non-light sensitive colloid layer. The arrangement of the layers provided on a support is not limited in the present invention.

Color developing process is subjected to obtain a dye image after exposure to light by using the light sensitive material of the invention.

Color processing comprises a color development, bleaching, fixing, water washing and stabilization if necessary, and monobath bleach-fixing may be use in replace of a process using bleacher and a process using fixer, and further, monobath developing-bleaching-fixing process may be replaced with the development, bleaching and fixing.

Now, the invention will be detailed with reference to the following preferred embodiments.

EXAMPLE 1

Sample 101 of multilayered silver halide color photographic light sensitive materials was prepared in the following manner. Over to a polyethylene-laminated paper support containing polyethylene on one side thereof and titanium oxide on the other side thereof, each of the layers having the compositions shown in the following Tables 1 and 2 were coated thereover on the side of the polyethylene layer containing titanium oxide.

Coating solution for the 1st layer

Ethyl acetate of 60 cc was added and dissolved into 26.7 g of yellow coupler (EY-1), 10.0 g of dye-image stabilizer (ST-1), 6.67 g of a dye-image stabilizer (ST-2), 0.67 g of antistaining agent (HQ-1) and 6.67 g of high-boiling organic; solvent (DNP). The resulting solution was emulsified and dispersed in 220 cc of an aqueous 10% gelatin solution containing 7 cc of an aqueous 20% surfactant (SU-2) solution by making use of a supersonic homogenizer, so that a yellow coupler dispersed solution could be prepared.

The resulting dispersed solution was mixed with the following blue-sensitive silver halide emulsion (containing 8.67 g of silver) and anti irradiation dye (AIY-1) was further added thereto, so that the coating solution for the 1st layer could be prepared.

The coating solutions for the 2nd through 7th layers were also prepared in the same manner as the above-mentioned coating solution for the 1st layer. Besides, for the layer hardeners, (HH-1) were each added to the 2nd and 4th layers and (HH-2) to the 7th layer, respectively. For the coating aids, surfactants (SU-1) and (SU-3) were each added thereto so that the surface tension of each layer could be controlled.

| Layer | Composition | Amount added ($g/m^2$) |
|---|---|---|
| 7th layer (Protective layer) | Gelatin | 1.00 |
| 6th layer (UV absorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistaining agent (HQ-1) | 0.01 |
| | DNP | 0.20 |
| | PVP | 0.03 |
| | Anti-irradiation dye (AIC-1) | 0.02 |
| 5th layer (Red-sensitive layer) | Gelatin | 1.30 |
| | Red-sensitive silver chlorobromide emulsion (Em-R) | 0.21 |
| | Cyan coupler (EC-1) | 0.24 |
| | Cyan coupler (EC-2) | 0.08 |
| | Dye-image stabilizer (ST-1) | 0.20 |
| | Antistaining agent (HQ-1) | 0.01 |
| | HBS-1 | 0.20 |
| | DOP | 0.20 |
| 4th layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistaining agent (HQ-1) | 0.03 |
| | DNP | 0.40 |
| 3rd layer (Green-sensitive layer) | Gelatin | 1.40 |
| | Green-sensitive silver chlorobromide emulsion (Em-G) | 0.17 |
| | Magenta coupler (EM-1) | 0.75* |
| | DNP | 0.20 |
| | Dye-image stabilizer (ST-3) | 0.75* |
| | Anti-irradiation dye (AIM-1) | 0.01 |
| 2nd layer (Interlayer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Antimold (F-1) | 0.002 |
| 1st layer (Blue-sensitive layer) | Gelatin | 1.20 |
| | Blue-sensitive silver chlorobromide emulsion (Em-B) | 0.26 |
| | Yellow coupler (EY-1) | 0.80 |
| | Dye-image stabilizer (ST-1) | 0.30 |
| | Dye-image stabilizer (ST-2) | 0.20 |
| | Antistaining agent (HQ-1) | 0.02 |
| | Anti-irradiation dye (AIY-1) | 0.01 |
| | DNP | 0.20 |
| Support | Polyethylene-laminated paper sheet | |

*mili-mol/$m^2$

Amount of the silver halide emulsions added were each shown in terms of the silver contents.

The chemical structures of the compounds applied to each of the above-mentioned layers were as follows.

EY-1
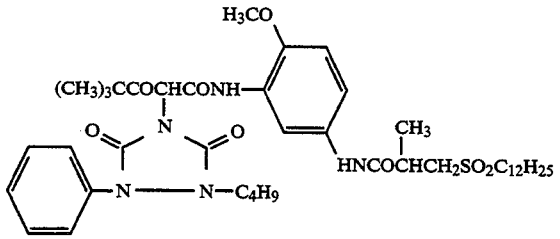
EC-1
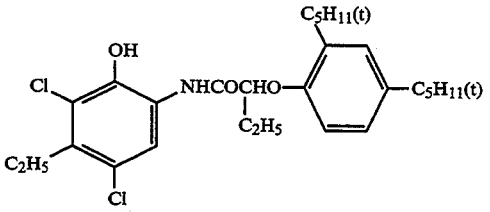
EC-2
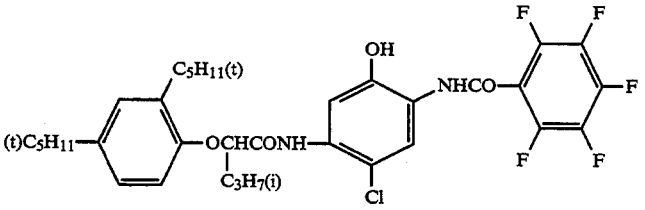
ST-1
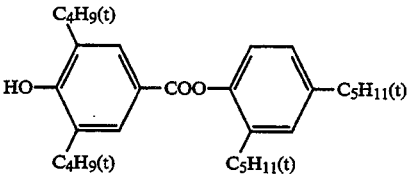
ST-2
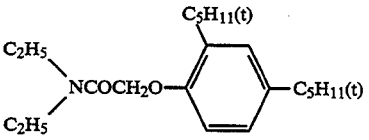
ST-3
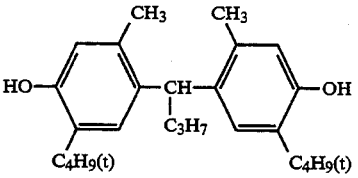
EM-1
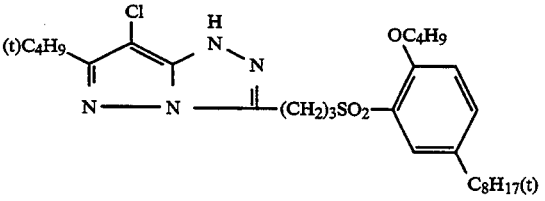
EM-2
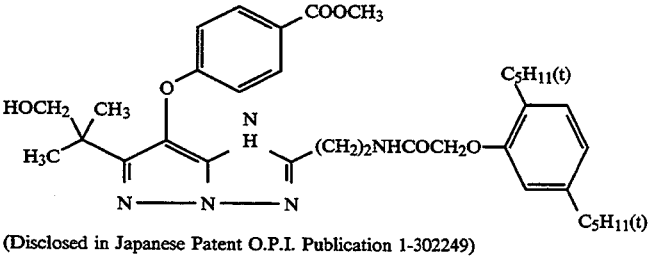
(Disclosed in Japanese Patent O.P.I. Publication 1-302249)

-continued
EM-3
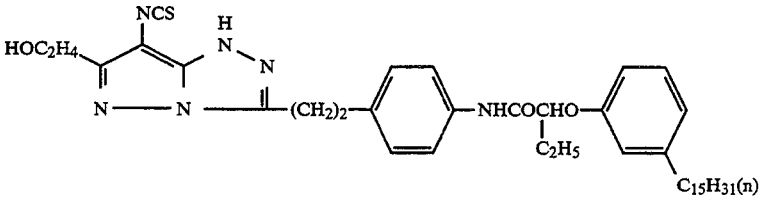
(Disclosed in Japanese Patent O.P.I. Publication 61-166546)
EM-12
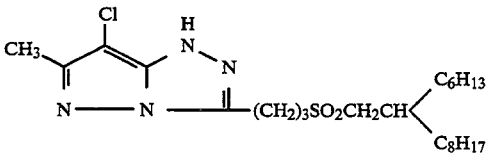
EM-13
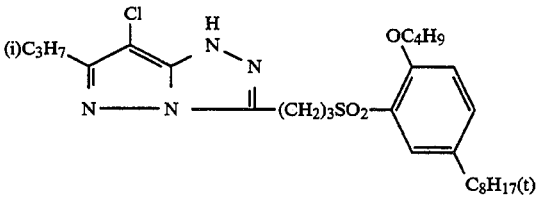
UV-1
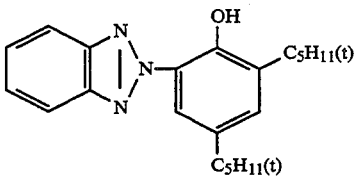
UV-2
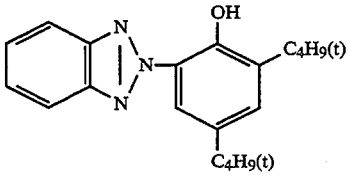
UV-3
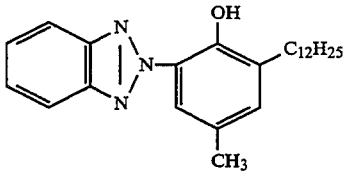
DOP: Dioctyl phthalate
DNP: Dinonyl phthalate
DIDP: Diisodecyl phthalate
PVP: Polyvinyl pyrrolidone
HQ-1
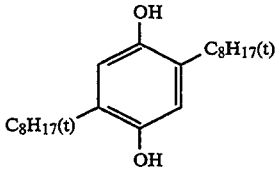
HQ-2
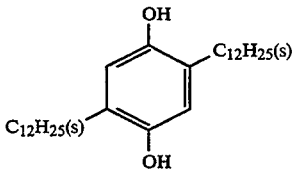

-continued
HQ-3
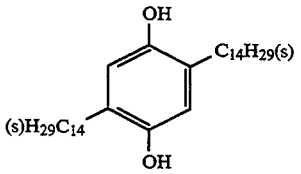
HQ-4
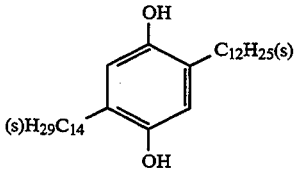
HQ-5
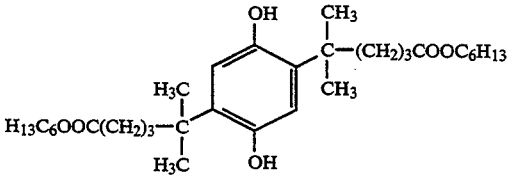
HBS-1
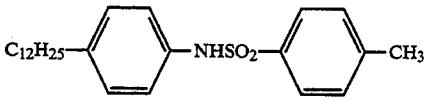
AIM-1
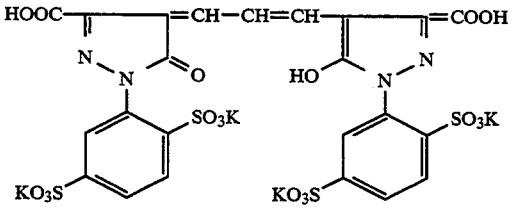
AIC-1
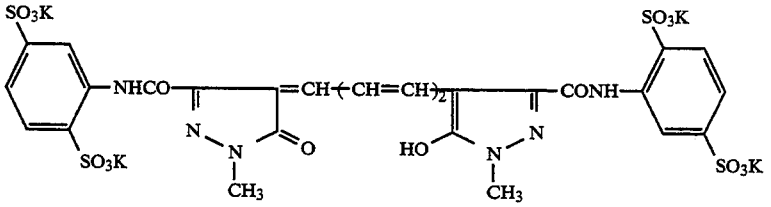
AIY-1
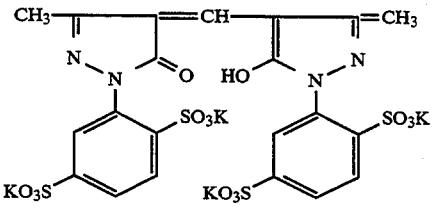
SU-1
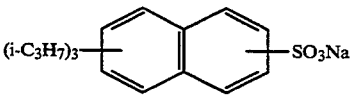
SU-2
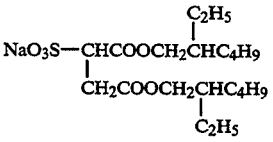
SU-3
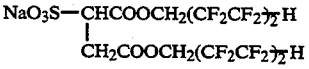

-continued $C(CH_2SO_2CH{=}CH_2)_4$ HH-1

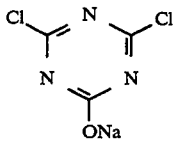

HH-2

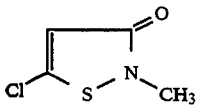

F-1

Blue-sensitive silver halide emulsion (Em-B)

This was a monodisperse type cubic silver chlorobromide emulsion having an average grain size of 0.85 μm, a variation coefficient of 0.07 and a silver chloride content of 99.5 mol %.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mols/mol of AgX |
| Sensitizing dye BS-1 | $4 \times 10^{-4}$ mols/mol of AgX |
| Sensitizing dye BS-2 | $1 \times 10^{-4}$ mols/mol of AgX |

Green-sensitive silver halide emulsion (Em-G)

This was a monodisperse type cubic silver chlorobromide emulsion having an average grain size of 0.43 μm, a variation coefficient of 0.08 and a silver chloride content of 99.5 mol %.

| | |
|---|---|
| Sodium thiosulfate | 1.5 mg/mol of AgX |

-continued

| | |
|---|---|
| Chloroauric acid | 1.0 mg/mol of AgX |
| Stabilizer STAB-1 | $6 \times 10^{-4}$ mols/mol of AgX |
| Sensitizing dye GS-1 | $4 \times 10^{-4}$ mols/mol of AgX |

Red-sensitive silver halide emulsion (Em-R)

This was a monodisperse type cubic silver chlorobromide emulsion having an average grain size of 0.50 μm, a variation coefficient of 0.08 and a silver chloride content of 99.5 mol %.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mols/mol of AgX |
| Sensitizing dye RS-1 | $1 \times 10^{-4}$ mols/mol of AgX |

The chemical structures of the compounds applied to each of the monodisperse type cubic emulsions were as follows.

BS-1

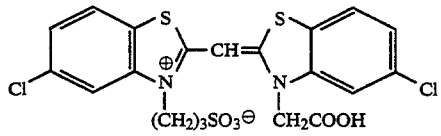

BS-2

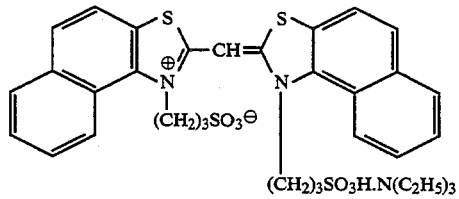

GS-1

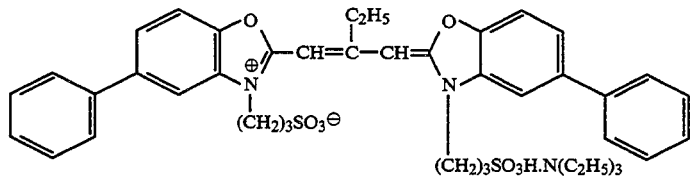

RS-1

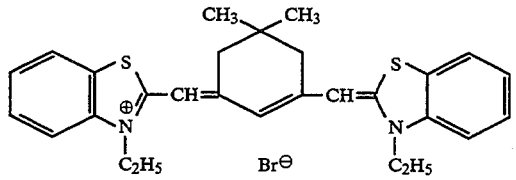

-continued

STAB-1

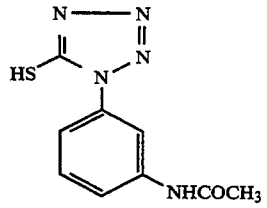

Next, Samples 102 through 109 were each prepared in the same manner as in Sample 101, except that the coupler EM-i of the 3rd layer was replaced by the same mols of the coupler of the invention shown in the following Table-3 and the dye-image stabilizer was replaced by those shown in Table-3, respectively.

The resulting samples were each exposed to green light through a wedge in an ordinary procedures and they were then processed in the following processing steps.

| Processing step | Temperature | Time |
|---|---|---|
| Color developing | 35.0 ± 0.3° C. | 45 sec |
| Bleach-fixing | 35.0 ± 0.5° C. | 45 sec |
| Stabilizing | 30 to 34° C. | 90 sec |
| Drying | 60 to 80° C. | 60 sec |

The compositions of each of the processing solution will be given below.

The processing solutions were each replenished in an amount of 80 cc per $m^2$ of a subject silver halide color photographic light sensitive material.

| Color developer | Tank solution | Replenishing solution |
|---|---|---|
| Deionized water | 800 ml | 800 ml |
| Triethanol amine | 10 g | 18 g |
| N,N-diethyl hydroxyl amine | 5 g | 9 g |
| Potassium chloride | 2.4 g | — |
| 1-hydroxyethylidene-1,1-diphosphoric acid | 1.0 g | 1.8 g |
| N-ethyl-N-β-methanesulfonamidoethyl-3-methyl-4-aminoaniline sulfate | 5.4 g | 8.2 g |
| Fluorescent whitening agent, (a 4,4'-diaminostilbene sulfonic acid derivative) | 1.0 g | 1.8 g |
| Potassium carbonate | 27 g | 27 g |
| Add water to make in total of 1000 cc | | |
| Adjust pH values of the tank solution to be 10.0 and of the replenisher to be 10.60, respectively. | | |

| Bleach-fixer (The same in both of the tank solution and the replenishing solution) | |
|---|---|
| Ferric ammonium ethylenediamine tetraacetate, dihydrate | 60 g |
| Ethylenediaminetetraacetic acid | 3 g |
| Ammonium thiosulfate (in an aqueous 70% solution) | 100 cc |
| Ammonium sulfite (in an aqueous 40% solution) | 27.5 cc |
| Add water to make in total of | 1000 cc |
| Adjust pH with potassium carbonate or glacial acetic acid to be | pH 5.7 |

| Stabilizer (The same in both of the tank solution and the replenisher) | |
|---|---|
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (in an aqueous 20% solution) | 3.0 g |
| Fluorescent whitening agent (a 4,4'-diaminostilbene sulfonic acid derivative) | 1.5 g |
| Add water to make in total of | 1000 cc |
| Adjust pH with sulfuric acid or potassium hydroxide to be | pH 7.0 |

The following evaluation were each carried out by making use of the samples which were continuously processed.

Light-fastness

The resulting samples were each exposed to a Xenon fade-o-meter for 14 days and the dye image residual percentage (%) thereof at the initial density of 1.0 were found out.

λmax; Maximum absorption wave length at a wedge of reflecting optical density of 1.0.

Abs600; Absorbency at a wedge of reflecting optical density of 1.0 at 600 nm. (Relative value taking the absorbency at λmax being 1.0 )

Dmax The maximum color densities thereof were measured.

The results thereof are shown in Table 3.

TABLE 3

| Sample No. | Magenta coupler | λmax | Abs600 | Dmax | Light-fastness (residual %) |
|---|---|---|---|---|---|
| 101 (Comp.) | EM-1 | 547 | 0.42 | 1.96 | 52 |
| 102 (Comp.) | EM-2 | 549 | 0.40 | 2.10 | 55 |
| 103 (Inv.) | 1 | 548 | 0.34 | 2.35 | 64 |
| 104 (Inv.) | 4 | 547 | 0.34 | 2.41 | 63 |
| 105 (Inv.) | 11 | 546 | 0.36 | 2.40 | 66 |
| 106 (Inv.) | 16 | 547 | 0.32 | 2.37 | 65 |
| 107 (Inv.) | 21 | 548 | 0.36 | 2.10 | 59 |
| 108 (Comp.) | EM-3 | 546 | 0.37 | 2.19 | 42 |
| 109 (Inv.) | 19 | 549 | 0.31 | 2.41 | 55 |
| 1102 (Inv.) | 101 | 546 | 0.35 | 2.30 | 67 |
| 1103 (Inv.) | 150 | 548 | 0.34 | 2.49 | 62 |
| 1104 (Inv.) | 107 | 546 | 0.34 | 2.41 | 65 |
| 1105 (Inv.) | 112 | 549 | 0.32 | 2.42 | 66 |
| 1106 (Inv.) | 122 | 545 | 0.31 | 2.39 | 62 |
| 1107 (Inv.) | 125 | 547 | 0.34 | 2.39 | 67 |
| 1108 (Inv.) | 136 | 548 | 0.37 | 2.10 | 60 |
| 1109 (Inv.) | 143 | 547 | 0.33 | 2.29 | 64 |
| 1110 (Comp.) | EM-12 | 549 | 0.32 | 2.40 | 30 |
| 1111 (Comp.) | EM-13 | 546 | 0.35 | 2.19 | 46 |
| 1112 | 105 | 548 | 0.31 | 2.40 | 57 |

TABLE 3-continued

| Sample No. | Magenta coupler | λmax | Abs600 | Dmax | Light-fastness (residual %) |
|---|---|---|---|---|---|
| (Inv.) | | | | | |
| 1113 (Inv.) | 109 | 549 | 0.32 | 2.48 | 57 |
| 1114 (Inv.) | 111 | 547 | 0.33 | 2.49 | 56 |

In Samples No. 101 through No. 107 and No. 1102 through No. 1109 each shown in Table 3, using couplers having a tertiary group as the substituent at the 6th position connecting point to triazole cycle, Samples Nos. 102 to 107 and No. 1102 through No. 1109 using the couplers of the invention are improved in the light-fastness and color developing property. In Samples No. 1110 through No. 1114, and No. 108 and No. 109 the couplers thereof having a substituted primary or secondary group as the substituents at the 6th position, Samples 109 and 1111 to 1114 using couplers of the invention show the similar advantageous result.

EXAMPLE 2

Samples No. 201 through No. 215 and 1204 through 1215 were each prepared in the same manner as in Sample No. 101 of Example 1, except that the dye-image stabilizer ST-3 used in the 3rd layer of Example 1 was replaced by the combination of those shown in the following Table 4.

The same evaluation as in Example 1 was each carried out by making use of the resulting samples. The results thereof are shown in Table 4.

ST-4

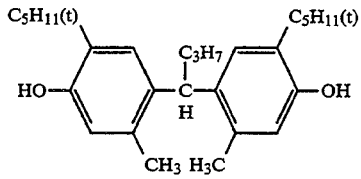

ST-5

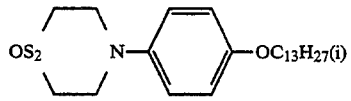

ST-6

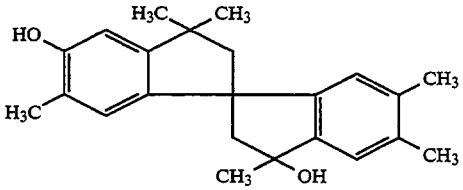

ST-7

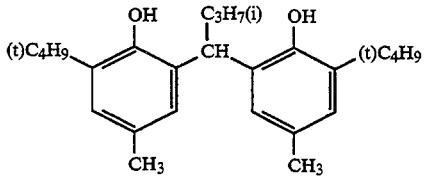

ST-8

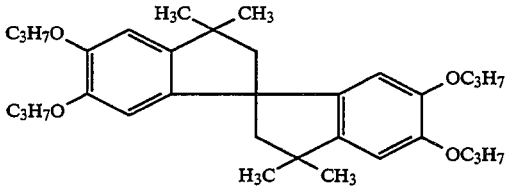

TABLE 4

| Sample No | Magenta coupler in 3rd layer | Dye-image stabilizer* | λmax | Abs600 | Dmax | Light fastness residual % |
|---|---|---|---|---|---|---|
| 201 (Comp.) | EM-1 | ST-4(1) ST-5(1) | 547 | 0.40 | 1.97 | 68 |
| 202 (Comp.) | EM-1 | ST-6(1) ST-7(1) | 547 | 0.41 | 1.90 | 65 |
| 203 (Comp.) | EM-1 | ST-5(1) ST-6(1) | 548 | 0.43 | 1.94 | 66 |
| 204 (Inv.) | 1 | ST-4(1) ST-5(1) | 546 | 0.35 | 2.41 | 87 |
| 205 (Inv.) | 1 | ST-6(1) ST-7(1) | 547 | 0.36 | 2.39 | 82 |
| 206 (Inv.) | 1 | ST-5(1) ST-6(1) | 547 | 0.37 | 2.44 | 84 |
| 207 (Inv.) | 8 | ST-4(1) ST-5(1) | 548 | 0.31 | 2.38 | 84 |
| 208 (Inv.) | 8 | ST-6(1) ST-7(1) | 549 | 0.34 | 2.40 | 81 |
| 209 (Inv.) | 8 | ST-5(1) ST-6(1) | 549 | 0.33 | 2.15 | 82 |
| 210 (Inv.) | 16 | ST-4(1) ST-5(1) | 547 | 0.32 | 2.18 | 85 |
| 211 (Inv.) | 16 | ST-6(1) ST-7(1) | 546 | 0.33 | 2.38 | 80 |
| 212 (Inv.) | 16 | ST-5(1) ST-6(1) | 547 | 0.38 | 2.14 | 84 |
| 213 (Inv.) | 21 | ST-5(1) ST-6(1) | 548 | 0.37 | 2.20 | 81 |
| 214 (Inv.) | 21 | ST-6(1) ST-7(1) | 548 | 0.36 | 2.18 | 80 |
| 215 (Inv.) | 21 | ST-7(1) ST-8(1) | 547 | 0.36 | 2.24 | 82 |
| 1204 (Inv.) | 101 | ST-4(1) ST-5(1) | 546 | 0.36 | 2.41 | 86 |
| 1205 (Inv.) | 101 | ST-6(1) ST-7(1) | 547 | 0.36 | 2.39 | 82 |

TABLE 4-continued

| Sample No | Magenta coupler in 3rd layer | Dye-image stabilizer* | λmax | Abs600 | Dmax | Light fastness residual % |
|---|---|---|---|---|---|---|
| 1206 (Inv.) | 101 | ST-5(1) ST-6(1) | 546 | 0.37 | 2.38 | 83 |
| 1207 (Inv.) | 112 | ST-4(1) ST-5(1) | 549 | 0.34 | 2.38 | 82 |
| 1208 (Inv.) | 112 | ST-6(1) ST-7(1) | 548 | 0.35 | 2.32 | 80 |
| 209 (Inv.) | 112 | ST-5(1) ST-6(1) | 549 | 0.33 | 2.32 | 80 |
| 1210 (Inv.) | 125 | ST-4(1) ST-5(1) | 547 | 0.35 | 2.40 | 84 |
| 1211 (Inv.) | 125 | ST-6(1) ST-7(1) | 548 | 0.37 | 2.29 | 82 |
| 1212 (Inv.) | 125 | ST-5(1) ST-6(1) | 547 | 0.37 | 2.33 | 81 |
| 1213 (Inv.) | 136 | ST-5(1) ST-6(1) | 548 | 0.36 | 2.18 | 82 |
| 1214 (Inv.) | 136 | ST-6(1) ST-7(1) | 548 | 0.37 | 2.19 | 80 |
| 1215 (Inv.) | 136 | ST-7(1) ST-8(1) | 548 | 0.37 | 2.22 | 82 |

*The values enclosed in the parentheses in the column of the dye-image stabilizers indicate the mol ratios thereof to the magenta couplers used.

It was proved from the contents of Table 4 that when the magenta coupler of Formula M-I is used in combination with certain dye-image stabilizer, the light-fastness, color reproduction and color developability thereof are remarkably improved.

EXAMPLE 3

One of the surface (emulsion side) of triacetylcellulose film support was subjected subbing treatment, and on the opposite side thereof (backing side) layers composed of following formulae in order from the support were provided. The amount of the additives in the silver halide light sensitive material is shown the amount per 1 $m^2$, provided otherwise disclosed. The amount of silver halide and colloid silver is shown the converted amount to silver.

| | |
|---|---|
| Backing 1st layer | |
| Alumina sol AS-100 (aluminum oxide) (Product of Nissan Kagaku Kogyo Co.) | 0.8 g |
| Backing 2nd layer | |
| Diacetyl cellulose | 100 mg |
| Stearic acid | 10 mg |
| Silica fine particles (Average particle size 0.2 μm) | 50 mg |

Each layer having the following composition was coated in order on the emulsion side of the subbing treated triacetylcellulose film to obtain a multi-layered color photographic light sensitive material 101.

| | |
|---|---|
| First layer; Anti-halation layer (Hc) | |
| Black colloidal silver | 0.15 g |
| UV absorbent UV-4 | 0.20 g |
| Colored cyan coupler CC-1 | 0.02 g |
| High boiling solvent DOP | 0.20 g |
| High boiling solvent TCP | 0.20 g |
| Gelatin | 1.6 g |
| 2nd layer: intermediate layer IL-1 | |
| Gelatin | 1.3 g |
| 3rd layer: low-speed red-sensitive emulsion layer R-L | |
| Silver iodobromide emulsion (average grain size: 0.3 μm, average iodide content: 2.0 mol %) | 0.4 g |
| Silver iodobromide emulsion (average grain size: 0.4 μm, average iodide content: 8.0 mol %) | 0.3 g |

-continued

| | |
|---|---|
| Sensitizing dye RS-2 | $3.2 \times 10^{-4}$ (mol/mol of silver) |
| Sensitizing dye RS-3 | $3.2 \times 10^{-4}$ (mol/mol of silver) |
| Sensitizing dye RS-4 | $0.2 \times 10^{-4}$ (mol/mol of silver) |
| Cyan coupler EC-3 | 0.50 g |
| Cyan coupler EC-4 | 0.13 g |
| Colored cyan coupler CC-1 | 0.07 g |
| DIR compound D-1 | 0.006 g |
| DIR compound D-2 | 0.01 g |
| High boiling solvent DOP | 0.55 g |
| Gelatin | 1.0 g |
| 4th layer: high-speed red-sensitive emulsion layer R-H | |
| Silver iodobromide emulsion (average grain size: 0.7 μm, average iodide content: 7.5 mol %) | 0.9 g |
| Sensitizing dye RS-2 | $1.7 \times 10^{-4}$ (mol/mol of silver) |
| Sensitizing dye RS-3 | $1.6 \times 10^{-4}$ (mol/mol of silver) |
| Sensitizing dye RS-4 | $0.1 \times 10^{-4}$ (mol/mol of silver) |
| Cyan coupler EC-4 | 0.23 g |
| Colored cyan coupler CC-1 | 0.03 g |
| DIR compound D-2 | 0.02 g |
| High boiling solvent DOP | 0.25 g |
| Gelatin | 1.0 g |
| 5th layer: intermediate layer IL-2 | |
| Gelatin | 0.8 g |
| 6th layer: low-speed green-sensitive emulsion layer G-L | |
| Silver iodobromide emulsion (average grain size: 0.4 μm, average iodide content: 8.0 mol %) | 0.6 g |
| Silver iodobromide emulsion (average grain size: 0.3 μm, average iodide content: 2.0 mol %) | 0.2 g |
| Sensitizing dye GS-2 | $6.7 \times 10^{-4}$ (mol/mol of silver) |
| Sensitizing dye GS-3 | $0.8 \times 10^{-4}$ (mol/mol of silver) |
| Magenta coupler EM-4 | 0.45 g |
| Colored magenta coupler CM-1 | 0.10 g |
| DIR compound D-3 | 0.02 g |
| High boiling solvent TCP | 0.7 g |
| Gelatin | 1.0 g |
| 7th layer: high-speed green-sensitive layer G-H | |
| Silver iodobromide emulsion (average grain size: 0.7 μm, average iodide content: 7.5 mol %) | 0.9 g |
| Sensitizing dye GS-4 | $1.1 \times 10^{-4}$ (mol/mol of silver) |
| Sensitizing dye GS-5 | $2.0 \times 10^{-4}$ |

-continued

| | |
|---|---|
| | (mol/mol of silver) |
| Sensitizing dye GS-6 | $0.3 \times 10^{-4}$ (mol/mol of silver) |
| Magenta coupler EM-4 | 0.35 g |
| Colored magenta coupler CM-1 | 0.04 g |
| DIR compound D-3 | 0.004 g |
| High boiling solvent TCP | 0.35 g |
| Gelatin | 1.0 g |
| 8th layer: yellow filter layer YC | |
| Yellow colloidal silver | 0.1 g |
| Additive HS-1 | 0.07 g |
| Additive HS-2 | 0.07 g |
| Additive SC-1 | 0.12 g |
| High boiling solvent Oil-2 | 0.15 |
| Gelatin | 1.0 g |
| 9th layer: low-speed blue-sensitive emulsion layer B-L | |
| Silver iodobromide emulsion (average grain size: 0.3 μm, average iodide content: 2.0 mol %) | 0.25 g |
| Silver iodobromide emulsion (average grain size: 0.4 μm, average iodide content: 8.0 mol %) | 0.25 g |
| Sensitizing dye BS-3 | $5.8 \times 10^{-4}$ (mol/mol of silver) |
| Yellow coupler EY-2 | 0.6 g |
| Yellow coupler EY-3 | 0.32 g |
| DIR compound D-1 | 0.003 g |
| DIR compound D-2 | 0.006 g |
| High boiling solvent TCP | 0.18 g |
| Gelatin | 1.3 g |
| 10th layer: high-speed blue-sensitive emulsion layer B-H | |
| Silver iodobromide emulsion (average grain size: 0.8 μm, average iodide content: 8.5 mol %) | 0.5 g |
| Sensitizing dye BS-4 | $3 \times 10^{-4}$ (mol/mol of silver) |
| Sensitizing dye BS-5 | $1.2 \times 10^{-4}$ (mol/mol of silver) |
| Yellow coupler EY-2 | 0.18 g |
| Yellow coupler EY-3 | 0.10 g |
| High boiling solvent TCP | 0.05 g |
| Gelatin | 1.0 g |
| 11th layer: 1st protective layer PRO-1 | |
| Silver iodide (average grain size: 0.08 μm) | 0.3 g |
| UV absorbent UV-4 | 0.07 g |
| UV absorbent UV-5 | 0.10 g |
| Additive HS-1 | 0.2 g |
| Additive HS-2 | 0.1 g |
| High boiling solvent DOP | 0.07 g |
| High boiling solvent DBP | 0.07 g |
| Gelatin | 0.8 g |
| 12th layer: 2nd protective layer PRO-2 | |
| Compound A | 0.04 g |
| Compound B | 0.004 g |
| Polymethyl methacrylate (average particle size: 3 μm) | 0.02 g |
| Methyl methacrylate:ethyl methacrylate:methacrylic acid 3:3:4 (weight ratio) copolymer (average particle size: 3 μm) | 0.13 g |
| Gelatin | 0.7 g |

In addition to the above components, photographic light-sensitive materials 1 to 5 contained compounds Su-1 and Su-2, thickener, hardeners H-1 and H-2, stabilizer ST-1, antifoggants AF-1 and AF-2 (weight average molecular weights were 10,000 and 1,100,000, respectively), dyes AI-1 and AI-2, and compound DI-1 (9.4 mg/m$^2$) to prepare Sample 301.

Preparation of Silver Iodobromide Emulsion

The silver iodobromide emulsion used in the 10th layer was prepared by the following method.

Silver iodobromide grains having an average grain size of 0.33 μm (a silver iodide content of 2 mol %) were prepared by the double-jet method, using monodispersed silver iodobromide grains as seed grains.

While stirring the following solution G-1 under conditions of 70° C., pAg 7.8 and pH 7.0, 0.34 mol of the seed emulsion was added thereto.

Formation of Inner High Iodide Content Phase-Core Phase

Then, the following solutions H-1 and S-1 were added, while keeping the flow ratio at 1:1, in 86 minutes at an accelerated flow rate (the final flow rate was 3.6 times the initial flow rate).

Formation of Outer Low Iodide Content Phase-Shell Phase

Subsequently, the following solutions H-2 and S-2 were added at a flow ratio of 1:1 in 65 minutes, under conditions of pAg 10.1 and pH 6.0, while accelerating the flow rate so as to make the final flow rate 5.2 times the initial flow rate.

During grain formation, the pAg and pH were controlled with an aqueous solution of potassium bromide and an aqueous solution of 56% acetic acid. The resulting silver halide grains were desalted according to the usual flocculation method and redispersed with the addition of gelatin to give an emulsion, which was then adjusted to pH 5.8 and pAg 8.06 at 40° C.

The emulsion thus obtained was a monodispersed emulsion comprising octahedral silver iodobromide grains having an average grain size of 0.80 μm, a grain size distribution extent of 12.4% and a silver iodide content of 8.5 mol %.

| | |
|---|---|
| Solution G-1 | |
| Ossein gelatin | 100.0 g |
| 10 wt % methanol solution of the following compound-I | 25.0 ml |
| 28% aqueous ammonia | 440.0 ml |
| 56% aqueous acetic acid solution | 660.0 ml |
| Water was added to | 5,000.0 ml |
| Solution H-1 | |
| Ossein gelatin | 82.4 g |
| Potassium bromide | 151.6 g |
| Potassium iodide | 90.6 g |
| Water was added to | 1,030.5 ml |
| Solution S-1 | |
| Silver nitrate | 309.2 g |
| 28% Aqueous ammonia | equivalent |
| Water was added to | 1,030.5 ml |
| Solution H-2 | |
| Ossein gelatin | 302.1 g |
| Potassium bromide | 770.0 g |
| Potassium iodide | 33.2 g |
| Water was added to | 3,776.8 ml |
| Solution S-2 | |
| Silver nitrate | 1,133.0 g |
| 28% Aqueous ammonia | equivalent |
| Water was added to | 3,776.8 ml |

The silver iodobromide emulsions used in the emulsion layers other than the 10th layer were prepared in the same way so as to give different average grain sizes and silver iodide contents, by varying the average grain size of seed grains, temperature, pAg, pH, flow rate, addition time and halide composition.

Each of these emulsions, which were monodispersed emulsions comprised core/shell type grains having a distribution extent not more than 20%, was obtained. Each emulsion was optimally chemically ripened in the presence of sodium thiosulfate, chloroauric acid and ammonium thiocyanate. Then, sensitizing dyes, 4-hydroxy-6-methyl-1,3,3a,7-tetrazaindene and 1-phenyl-5-mercaptotetrazole were added thereto.

EC-3
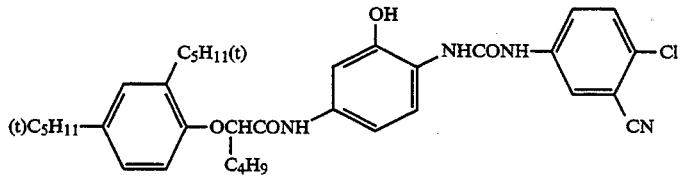
EC-4
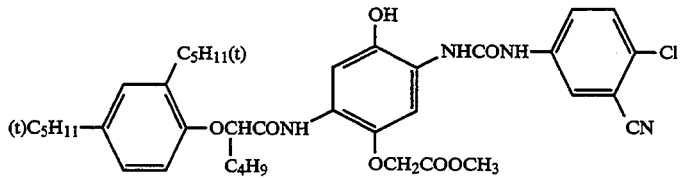
EM-4
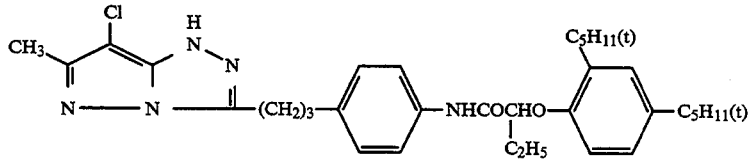
EY-2
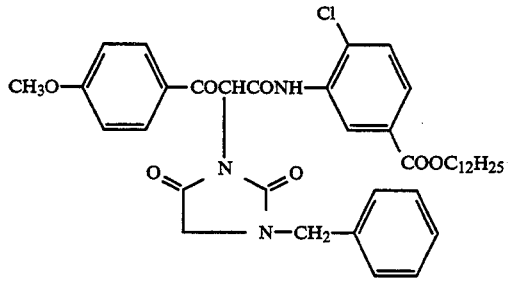
EY-3
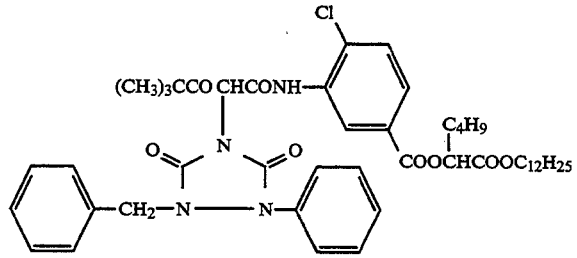
CC-1
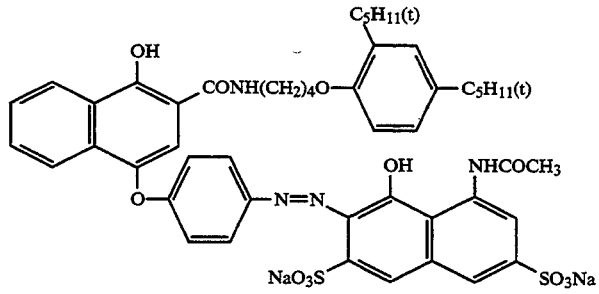
CM-1
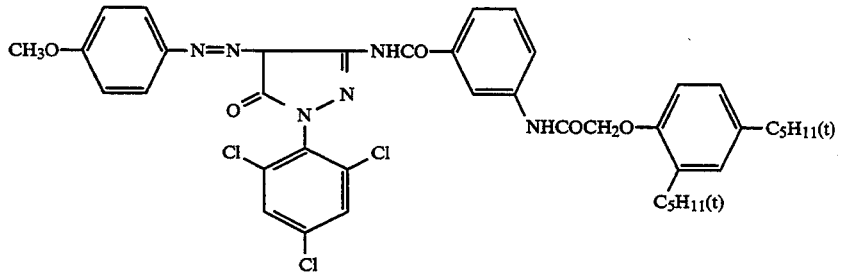

-continued
D-1
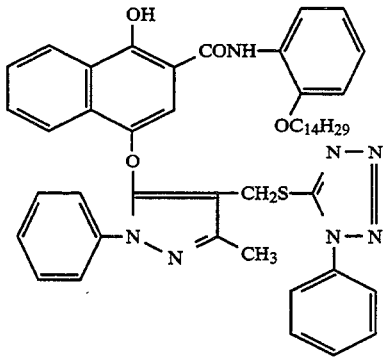
D-2
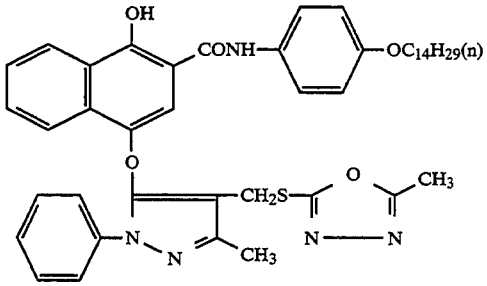
D-3
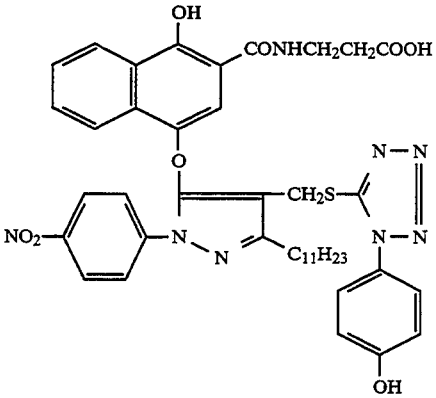
UV-4
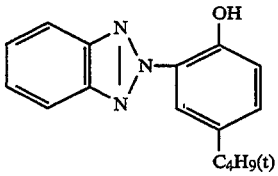
UV-5
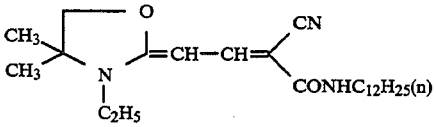
RS-2
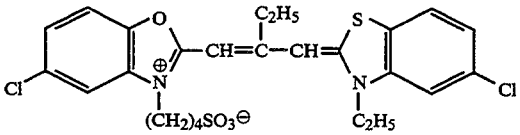

-continued
RS-3
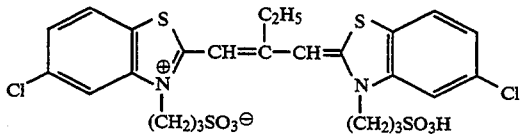
RS-4
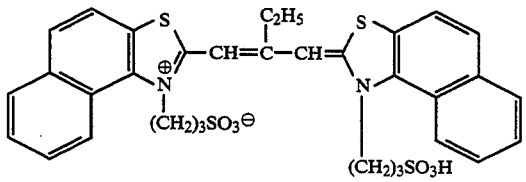
GS-2
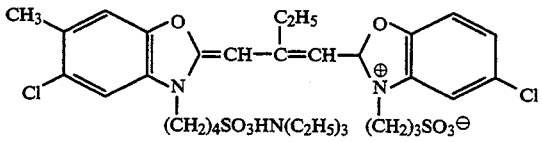
GS-3
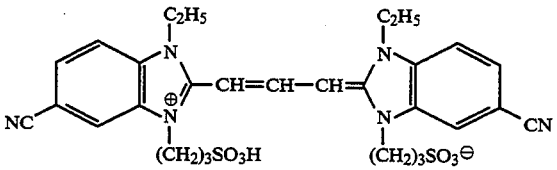
GS-4
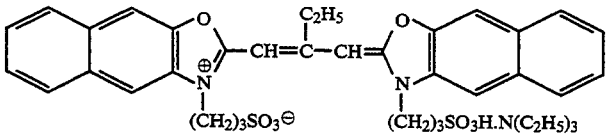
GS-5
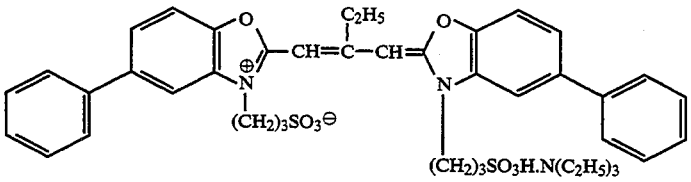
GS-6
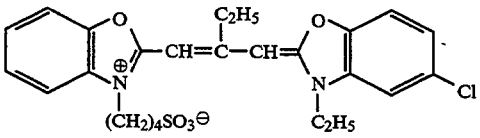
BS-3
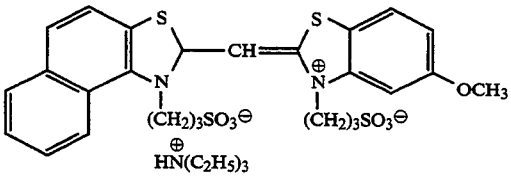
BS-4
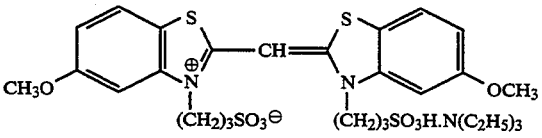

-continued
BS-5
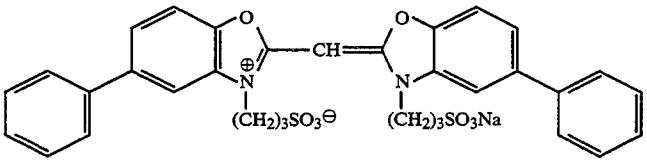
HS-1
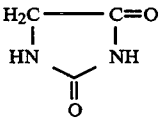
HS-2
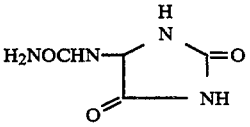
SC-1
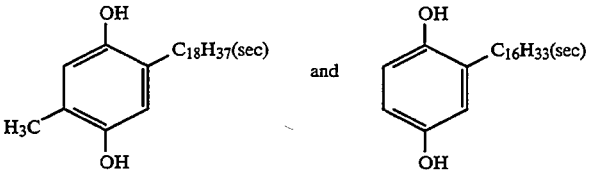
(mixture of 2:3)
Dioctylphthalate DOP
Dibutylphthalate DBP
Tricredylphosfate TCP
HH-2
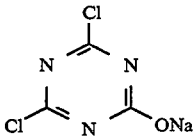
HH-3
$(CH_2{=}CHSO_2CH_2)_4C$
SU-1
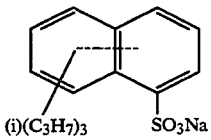
SU-2
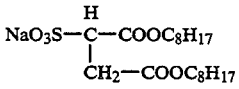
AI-1
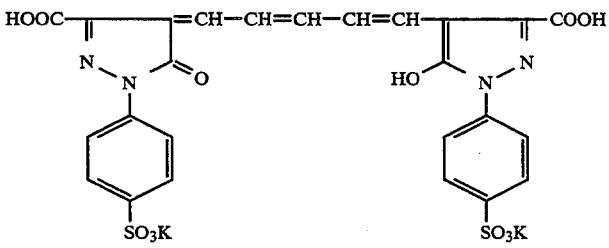

-continued

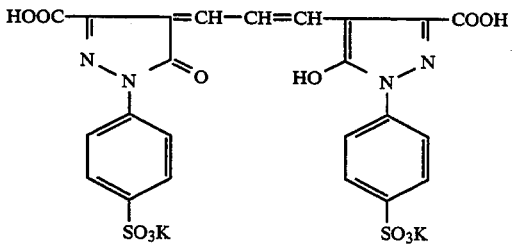

AI-2

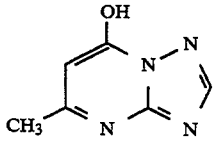

ST-1

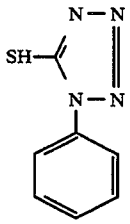

AF-1

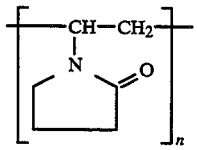

AF-2

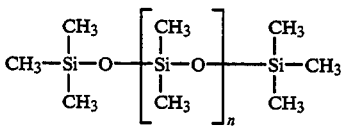

Compound A weight average molecular weight = 30,000

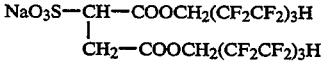

Compound B (A mixture of the following three components)

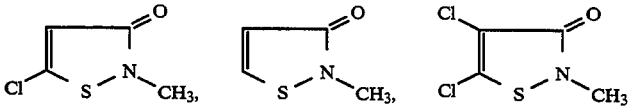

DI-1

Component A Component B Component C component A:component B:component C = 50:46:4 (mole ratio)

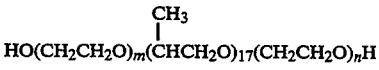

Compound-I (Average molecular weight about 1/300)

Samples 302 through 307 and 1303 through 1311 were prepared in the same way as Sample 301 except that the magenta couplers in 6th and 7th layers were replaced with those shown in Table 6. Thus prepared samples 301 through 307 and 1303 through 1311 were exposed through step wedge by white light, and they were processed according to the following process I.

| | Developing Process I | | |
|---|---|---|---|
| Processing step | Processing time | Processing temperature | Replenishing amount* |
| Color Development | 3 min. 15 s | 38 ± 0.3° C. | 780 ml |
| Bleaching | 45 s | 38 ± 2.0° C. | 150 ml |
| Fixing | 1 min 30 s | 38 ± 2.0° C. | 830 ml |
| Stabilization | 60 s | 38 ± 5.0° C. | 830 ml |
| Drying | 1 min | 55 ± 5.0° C. | — |

*Value per 1 $m^2$ of light sensitive material.

Color developer, bleacher, fixer and stabilizer and the replenisher therefor are formulated as follows;

| Color developer | |
|---|---|
| Water | 800 ml |
| Potassium carbonate | 30 g |
| Sodiumhydrogencarbonate | 2.5 g |
| Potassium sulfate | 3.0 g |
| Sodium bromide | 1.3 g |
| Potassium iodide | 1.2 mg |
| Hydroxylamine sulfite | 2.5 g |
| Sodium chloride | 0.6 g |
| 4-amino-3-methyl-N-ethyl-N-(β-hydroxyethyl)-aniline sulfate | 4.5 g |
| Diethylenetriaminepentaacetic acid | 3.0 g |
| Potassium hydroxide | 1.2 g |
| Water is added to make 1 liter, and pH is adjusted to 10.0 by using potassium hydroxide or 20% sulfuric acid. | |
| **Color developer replenisher** | |
| Water | 800 ml |
| Potassium carbonate | 35 g |
| Sodiumhydrogencarbonate | 3 g |
| Potassium sulfate | 5 g |
| Sodium bromide | 0.5 g |
| Potassium iodide | 1.2 mg |
| Hydroxylamine sulfite | 3.1 g |
| Sodium chloride | 0.6 g |
| 4-amino-3-methyl-N-ethyl-N-(β-hydroxyethyl)-aniline sulfate | 6.3 g |
| Potassium hydroxide | 2 g |
| Diethylenetriaminepentaacetic acid | 3.0 g |
| Water is added to make 1 liter, and pH is adjusted to 10.18 by using potassium hydroxide or 20% sulfuric acid. | |
| **Bleacher** | |
| Water | 700 ml |
| 1,3-diaminopropanetetraacetic acid iron(III) ammonium salt | 125 g |
| Ethylenediamineteraacetic acid | 2 g |
| Sodium nitrate | 40 g |
| Ammonium bromide | 150 g |
| Glacial acetic acid | 40 g |
| Water is added to make 1 liter, and pH is adjusted to 4.4 by using ammoniac water or glacial acetic acid. | |
| **Bleacher replenisher** | |
| Water | 700 ml |
| 1,3-diaminopropanetetraacetic acid iron(III) ammonium salt | 175 g |
| Ethylenediaminetetraacetic acid | 2 g |
| Sodium nitrate | 50 g |
| Ammonium bromide | 200 g |
| Glacial acetic acid | 56 g |
| pH is adjusted to 4.0 by using ammoniacal water or glacial acetic acid, and then water is added to make 1 liter. | |
| **Fixer** | |
| Water | 800 ml |
| Ammonium thiocyanate | 120 g |
| Ammonium thiosulfate | 150 g |
| Sodium sulfite | 15 g |
| Ethylenediaminetetraacetic acid | 2 g |
| pH is adjusted to 6.2 by using ammoniacal water or glacial acetic acid, and then water is added to make 1 liter. | |
| **Fixer replenisher** | |
| Water | 800 ml |
| Ammonium thiocyanate | 150 g |
| Ammonium thiosulfate | 180 g |
| Sodium sulfite | 20 g |
| Ethylenediaminetetraacetic acid | 2 g |
| pH is adjusted to 6.5 by using ammoniacal water or glacial acetic acid, and then water is added to make 1 liter. | |
| **Stabilizer and replenisher therefor** | |
| Water | 900 ml |
| 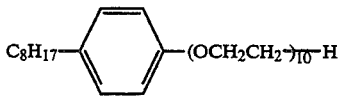 | 2.0 g |
| Dimethylol urea | 0.5 g |
| Hexamethylene tetraamine | 0.2 g |
| 1,2-benzoisothiazoline-3-on | 0.1 g |

-continued

| | |
|---|---|
| Cyloxane (UCC product L-77) | 0.1 g |
| Ammoniacal water | 0.5 ml |
| Water is added to make 1 liter, and pH is adjusted to 4.4 by using ammoniacal water or 50% sulfuric acid. | |

Samples 301 through 307 and 1303 through 1311 were also processed by developing process II that is the modification of the developing process I changing pH to 9.90.

Maximum density of developed magenta dye were measured with green light by means of an optical densitometer PDA-6 (Manufactured by Konica Corporation) for each Sample. Maximum density(Dmax), relative sensitivity and variation depending on pH are shown in Table 6. The variation depending on pH is defined by a ratio of $$\frac{\text{Maximum density by developing process II}}{\text{Maximum density by developing process I}}$$

in percent.

| Sample | Magenta Coupler | Dmax | Relative sensitivity | Variation by pH |
|---|---|---|---|---|
| 301 (Comp.) | EM-4 | 2.38 | 100 | 63 |
| 302 (Comp.) | EM-1 | 2.41 | 101 | 66 |
| 303 (Inv.) | 1 | 2.70 | 119 | 85 |
| 304 (Inv.) | 4 | 2.90 | 121 | 85 |
| 305 (Inv.) | 8 | 2.70 | 117 | 83 |
| 306 (Inv.) | 19 | 2.71 | 118 | 86 |
| 307 (Inv.) | 12 | 2.75 | 119 | 82 |
| 308 (Inv.) | 21 | 2.45 | 105 | 75 |
| 1303 (Inv.) | 101 | 2.72 | 119 | 85 |
| 1304 (Inv.) | 105 | 2.53 | 111 | 82 |
| 1305 (Inv.) | 109 | 2.72 | 113 | 81 |
| 1306 (Inv.) | 112 | 2.73 | 118 | 83 |
| 1307 (Inv.) | 122 | 2.59 | 114 | 82 |
| 1308 (Inv.) | 150 | 2.71 | 116 | 84 |
| 1309 (Inv.) | 136 | 2.56 | 108 | 77 |
| 1310 (Inv.) | 143 | 2.78 | 120 | 84 |
| 1311 (Inv.) | 148 | 2.81 | 117 | 83 |

The relative sensitivity in Table 6 is the relative value of reciprocal of exposure value to give an optical density of fogging plus 0.10, and is shown taking the value for sample 301 as 100. The values of relative sensitivity and Dmax are the values obtained by the developing process I.

As apparent from the Table 6, Samples 303 through 308 and 1303 through 1311 of the invention are superior in Dmax, sensitivity and variation depending on pH to the comparative samples 301 and 302.

The silver halide color photographic light sensitive material of the invention is appeared to have an excellent property in image storage ability, color developing property, color reproduction property, and variation of color developability depending on the variation of developing condition, especially pH variation of the developer.

We claim:

1. A silver halide color photographic light-sensitive material comprising a support and a light-sensitive silver halide emulsion layer wherein the silver halide color photographic light-sensitive material comprises a magenta coupler represented by

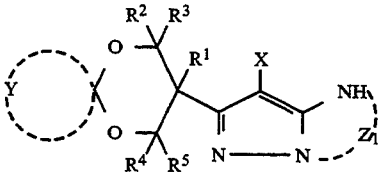

wherein $R^1$, $R^2$, $R^3$, $R^4$ and $R^5$ each represent a hydrogen atom, an aliphatic group, aromatic group or heterocyclic group, and $R^1$, $R^2$, $R^3$, $R^4$ and $R^5$ each are same or different, the aliphatic group and aromatic group each may have a substituent; X is a hydrogen atom, or a group or atom which is released upon the reaction with the oxidation product of developing agent; $Z_1$ is a non-metal group to form a 5-membered cycle in combination with a nitrogen atom; Y is a non-metal group to form a 3- to 7-membered cycle in combination with a carbon atom; the cycle represented by $Z_1$ and Y may have a sustituent.

2. A silver halide color photographic light sensitive material of claim 1 wherein the magenta coupler is

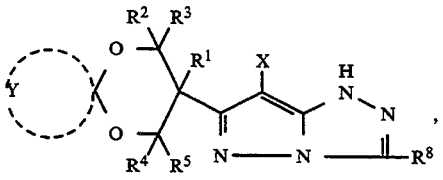

M-IIa

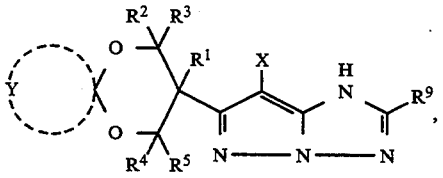

M-IIIa

-continued

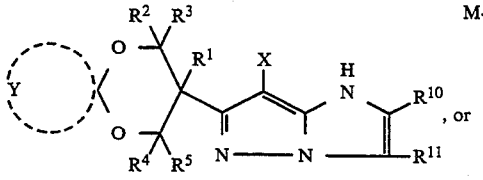

M-IVa

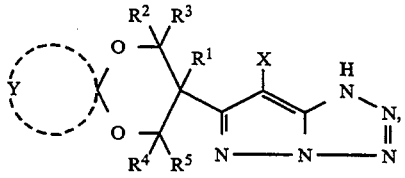

M-Va wherein $R^1$, $R^2$, $R^3$, $R^4$ and $R^5$ each represent a hydrogen atom, an aliphatic group, aromatic group or heterocyclic group, and $R^1$, $R^2$, $R^3$, $R^4$ and $R^5$ each are same or different, the aliphatic group and aromatic group each may have a substituent; $R^8$ through $R^{11}$ each are a hydrogen atom or a substituent; X is a hydrogen atom, or a group or atom which is released upon the reaction with the oxidation product of developing agent; Y is a non-metal group to form a 3- to 7-metered cycle in combination with a carbon atom; the cycle represented by Y may have a sustituent.

3. A silver halide color photographic light sensitive material of claim 2 wherein $R^1$, $R^2$, $R^3$, $R^4$ and $R^5$ each represent a hydrogen atom or an alkyl group.

4. A silver halide color photographic light sensitive material of claim 2 wherein the magenta coupler is

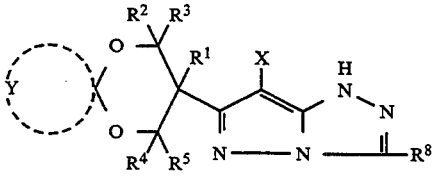

M-IIa wherein $R^1$, $R^2$, $R^3$, $R^4$ and $R^5$ each represent a hydrogen atom or an alkyl group; $R^8$ through $R^9$ each are a hydrogen atom or a substituent. X is a hydrogen atom, or a group or atom which is released upon the reaction with the oxidation product of developing agent; Y is a non-metal group to form a 3- to 7-membered cycle in combination with a carbon atom; the cycle represented by Y may have a sustituent.

5. A silver halide color photographic light sensitive material of claim 2 wherein Y is a group of cyclohexane, cycloheptane, cyclohexene, cycloheptene, piperidine, dioxane, furan, dioxene, cyclohexadiene-on, adamantane, cyclopropene or norbornene.

6. A silver halide color photographic light sensitive material of claim 2 wherein Y is cyclohexene, cycloheptane, piperidine or adamantane.

7. A silver halide color photographic light sensitive material of claim 1 wherein $R^1$ through $R^7$ each are a hydrogen atom or an alkyl group.

* * * * *